US010060603B2

(12) United States Patent
Honold et al.

(10) Patent No.: US 10,060,603 B2
(45) Date of Patent: Aug. 28, 2018

(54) SAFETY END CAP ASSEMBLY FOR A LED TUBE, AND LED TUBE ASSEMBLY COMPRISING A SAFETY END CAP ASSEMBLY

(71) Applicant: Silicon Hill B.V., Amsterdam (NL)

(72) Inventors: Jurgen Eduard Honold, Amsterdam (NL); Henk Emiel Cornelia Crone, The Hague (NL); Tom Hilgerink, Amsterdam (NL); Bregje Steenbeek, Rotterdam (NL)

(73) Assignee: SILICON HILL B.V., Amsterdam (NL)

( * ) Notice: Subject to any disclaimer, the term of this patent is extended or adjusted under 35 U.S.C. 154(b) by 30 days.

(21) Appl. No.: 15/035,500

(22) PCT Filed: Oct. 21, 2014

(86) PCT No.: PCT/NL2014/050735
§ 371 (c)(1),
(2) Date: May 10, 2016

(87) PCT Pub. No.: WO2015/069101
PCT Pub. Date: May 14, 2015

(65) Prior Publication Data

US 2016/0290606 A1 Oct. 6, 2016

(30) Foreign Application Priority Data

Nov. 11, 2013 (NL) ..... 2011780

(51) Int. Cl.
*F21V 21/00* (2006.01)
*F21V 15/015* (2006.01)
(Continued)

(52) U.S. Cl.
CPC ..... *F21V 15/015* (2013.01); *F21K 9/272* (2016.08); *F21V 23/02* (2013.01); *F21V 23/04* (2013.01);
(Continued)

(58) Field of Classification Search
CPC ... F21Y 2103/00; F21V 19/008; F21V 19/009
(Continued)

(56) References Cited

U.S. PATENT DOCUMENTS 8,330,362 B2 * 12/2012 Lin ..... F21V 3/02 313/512
8,456,319 B2 6/2013 Baker et al.
(Continued)

FOREIGN PATENT DOCUMENTS

DE 102010019875 A1 11/2011
DE 102015204716 A1 9/2016
(Continued)

OTHER PUBLICATIONS

International Search Report PCT/ISA/210 for International Application No. PCT/NL2014/050735 dated Feb. 4, 2015.
(Continued)

*Primary Examiner* — Daniel St Cyr
(74) *Attorney, Agent, or Firm* — Hoyng Rokh Monegier LLP; David P. Owen

(57) ABSTRACT

A safety end cap assembly includes an end cap base element to be arranged at one end thereof on an end of the elongate housing, at least one connector pin extending along a longitudinal axis of the end cap base element, an electrical switch electrically connected to the connector pin and switchable between an open state and a closed state, and an end cap cover element arranged slidable on the end cap base element between a protracted position where the switch button is covered by the end cap cover element, and a
(Continued)

retracted position, where the switch button is exposed. When protracted, the end cap cover element extends beyond the end of the end cap base element, and for sliding the end cap cover element from its protracted position to its retracted position, the end cap cover element is moved towards the end cap base element.

18 Claims, 11 Drawing Sheets

(51) Int. Cl.

| | |
|---|---|
| ***F21V 25/04*** | (2006.01) |
| ***F21V 23/04*** | (2006.01) |
| ***F21V 23/06*** | (2006.01) |
| ***H01R 13/447*** | (2006.01) |
| ***H01R 13/70*** | (2006.01) |
| ***H01R 33/08*** | (2006.01) |
| ***H01H 3/20*** | (2006.01) |
| ***F21V 29/70*** | (2015.01) |
| ***F21V 23/02*** | (2006.01) |
| ***F21K 9/272*** | (2016.01) |
| *F21Y 103/10* | (2016.01) |
| *F21Y 115/10* | (2016.01) |

(52) U.S. Cl.
CPC ..... *F21V 23/06* (2013.01); *F21V 25/04* (2013.01); *F21V 29/70* (2015.01); *H01H 3/20* (2013.01); *H01R 13/447* (2013.01); *H01R 13/70* (2013.01); *H01R 33/0836* (2013.01); *F21Y 2103/10* (2016.08); *F21Y 2115/10* (2016.08)

(58) Field of Classification Search
USPC ..... 362/217.1, 217.11, 217.12, 217.14
See application file for complete search history.

(56) References Cited

U.S. PATENT DOCUMENTS

| | | | | |
|---|---|---|---|---|
| 8,579,463 | B2 * | 11/2013 | Clough | F21L 4/00 362/217.1 |
| 8,672,508 | B2 * | 3/2014 | Pearson | F21V 17/02 362/217.01 |
| 9,028,090 | B2 * | 5/2015 | Nagashima | H05B 33/0803 362/217.01 |
| 2002/0008610 | A1 | 1/2002 | Peterson | |
| 2010/0171633 | A1 | 7/2010 | Baker et al. | |
| 2012/0043892 | A1 | 2/2012 | Visser et al. | |
| 2012/0106157 | A1 | 5/2012 | Simon et al. | |
| 2014/0003054 | A1 | 1/2014 | Simon et al. | |
| 2014/0009925 | A1 | 1/2014 | Verhoeven et al. | |

FOREIGN PATENT DOCUMENTS

| | | | |
|---|---|---|---|
| EP | 3069077 | A1 | 9/2016 |
| EP | 3141814 | A1 | 3/2017 |
| GB | 2100400 | A | 12/1982 |
| JP | 2013008475 | A | 1/2013 |
| NL | 1039021 | C | 3/2013 |
| WO | 2012058556 | A2 | 5/2012 |
| WO | 2016119935 | A1 | 8/2016 |

OTHER PUBLICATIONS

Written Opinion of the International Searching Authority PCT/ISA/237 for International Application No. PCT/NL2014/050735 dated Feb. 4, 2015.

* cited by examiner

SAFETY END CAP ASSEMBLY FOR A LED TUBE, AND LED TUBE ASSEMBLY COMPRISING A SAFETY END CAP ASSEMBLY

TECHNICAL FIELD

The present invention relates to a light emitting diode (LED) based lamp usable in a conventional fluorescent lighting fixture.

BACKGROUND

Fluorescent tube lamps are widely used in a variety of locations, such as schools and office buildings. Although conventional fluorescent lamps have certain advantages over, for example, incandescent lamps, they also pose certain disadvantages including, inter alia, disposal problems due to the presence of toxic materials within the glass tube.

Led-based tube lamps, or LED tubes, which can be used as one-for-one replacements for fluorescent tube lamps, have appeared in recent years. Such LED-based replacement lamps include an elongate housing having arranged therein LEDs mounted on a circuit board. An end cap is arranged at each longitudinal end of the housing. The end caps generally include a molded plastic cup-shaped body that slides over the end of the housing to secure the end cap to the housing. Additionally, each end cap can include one or more connector pins for electrically and/or mechanically connecting the replacement lamp with standard fluorescent lamp fixtures. For example, many end caps carry two connector pins for compatibility with fixtures designed to receive standard-sized tubes, such as T5, T8, T10 or T12 tubes and having standardized lamp holders, such as G5 and G13.

One problem when replacing a fluorescent tube lamp with a LED-based replacement lamp is the potential hazardous contact with the exposed connector pins during, for example, installation or relamping. In order to make a LED tube work with lamp fixtures designed for fluorescent tube lamps, a current path has to be provided between connector pins on either end of the LED tube. Accordingly, if the lamp fixture is energized when one end of the LED tube is plugged into the fixture and the LED tube is turned, it is possible that electrical current may flow through the body of the person installing the lamp to ground. Specifically, if one or more pins are exposed while at least one other pin is in electrical contact with the fixture, the person may experience electrical shock if they come in contact with the pins.

SUMMARY OF THE INVENTION

The present invention has among others as its object to reduce the shock hazard potential present in Led-based lamps having exposed connector pins.

To that end, the present invention provides a safety end cap to be arranged on an end of an elongate housing of a LED tube, and a LED tube assembly comprising a safety end cap.

The safety end cap assembly according to the invention comprises:

an end cap base element to be arranged at one end thereof on an end of the elongate housing;

at least one connector pin extending along a longitudinal axis of the end cap base element;

an electrical switch electrically connected to the connector pin and switchable between an open state and a closed state by means of a switch button arranged on the end cap base element; and an end cap cover element arranged slidable on the end cap base element along said longitudinal axis between a protracted position, in which the switch button is covered by the end cap cover element, and a retracted position, in which the switch button is exposed;

wherein in its protracted position the end cap cover element extends beyond the end of the end cap base element opposite to the end that is to be arranged on the end of the elongate housing; and wherein for sliding the end cap cover element from its protracted position to its retracted position, the end cap cover element is moved towards the end cap base element.

The safety end cap assembly according to the invention can advantageously be provided as an end cap at one end of a LED tube with the longitudinal axis of the safety end cap assembly extending parallel to or coinciding with the longitudinal axis of the LED tube, with the switch of the safety end cap assembly integrated in the circuitry of the LED tube as a circuit breaker switch in the current path between the connector pin of the safety end cap assembly and a connector pin of the end cap at the other end of the LED tube. With conventional lamp fixtures for fluorescent tube lamps the tube lamp is fit in between two spaced apart lamp holders. Since in its protracted position the end cap cover element extends beyond the end of the end cap base element opposite the end to be arranged on the end of the elongate housing of the LED tube and for sliding the end cap cover element from its protracted position to its retracted position, the end cap cover element is moved towards the end cap base element, the slidable end cap cover element of the safety end cap assembly according to the invention allows for a change of a length of the LED tube that is relevant for fitting the LED tube between the two spaced apart lamp holders by sliding the end cap cover element from its protracted position to its retracted position. The safety end cap assembly according to the invention thus makes it possible that a LED tube provided with the safety end cap assembly cannot be fit between the spaced apart lamp holders with the end cap cover element in its protracted position, while it can be fit between the spaced apart lamp holders with the end cap cover element in its retracted position. When such a LED tube is given to a person with the end cap cover element in its protracted position and the switch in its open state, that person has to slide the end cap cover element into its retracted position in order to fit the LED tube in the lamp fixture. Since the switch can only be brought in its closed state after exposing the switch button, i.e. only after the end cap cover element is slid into its retracted position, the person is stimulated to first completely fit the LED tube with both ends thereof in the lamp fixture and to subsequently bring the switch in its closed state by operating the switch button. With the switch in its open state there is no hazardous current path possible to the connector pins on either end of the LED tube, such that by stimulating the person to first fit the LED tube in the lamp fixture and to subsequently bring the switch in its closed state, the shock hazard potential during the fitting of the LED tube in the lamp fixture is reduced.

The majority of the fluorescent tube lamps that are on the market have two connector pins on either end thereof. To provide an end cap for a replacement for such fluorescent tube lamps, a safety end cap assembly according to the invention will have two connector pins. However, it would also be possible that a safety end cap assembly according to the invention has one, three, four, or more than four connector pins, depending on its specific application. In case more than one connector pin is provided, the electrical switch is connected to as many of the connector pins as is necessary to prevent a hazardous current path to a connector pin on the other end of the LED tube. A respective switch unit could be provided for each connector pin that is to be connected to a switch. Alternatively, a single switch unit could be connected to more than one connector pin and be arranged to simultaneously connect/disconnect the respective pins to/from the circuitry in which the LEDs are arranged.

In an advantageous embodiment the at least one connector pin is arranged on the end-cap base element. This feature makes it possible that between its protracted and retracted position the end cap cover element slides along the connector pin. This allows for bearing the end cap cover element both on the end cap base element and on the connector pin, which has the advantage that tilting of the end cap cover element relative to the longitudinal axis of the end cap base element is avoided. Furthermore, the additional feature according to this embodiment allows for a further advantageous embodiment, wherein in the retracted position of the end cap cover element, the connector pin is exposed; and in the protracted position of the end cap cover element, the end cap cover element covers the connector pin such that the connector pin is not exposed.

The additional features according to this advantageous embodiment further ensures that it is not possible to electrically and mechanically connect a LED tube provided with the safety end cap assembly to a lamp fixture when the end cap cover element is in its protracted position.

Alternatively, in a preferred embodiment, the at least one connector pin is arranged on the end-cap cover element. In this alternative embodiment, the connector pin is not covered when the end cap cover element is in its protracted position. This is in particular advantageous when the safety end cap assembly is provided with more than one connector pin, since the uncovered connector pins provide the person installing the LED lamp with a clear indication of the orientation of the connector pins which helps maneuvering the connector pins into the slot in the lamp holder of conventional fixtures. Furthermore, having the connector pin(s) arranged on the end cap cover element allows for a particular advantageous embodiment of the safety end cap assembly to reduce the complexity of the contact mechanism, with an integrated function to trigger the mechanism for automatically returning the safety end cap assembly to its initial position. This advantageous embodiment will be described later in the description.

In a further advantageous embodiment of the safety end cap assembly according to the invention, the safety end cap assembly further comprises:

a spring mechanism configured such that the end cap cover element is urged toward its protracted position; and a switch opening mechanism configured such that in case the switch is in its closed state and the end cap cover element is slid into its protracted position the switch is switched to its open state.

As a result of the spring mechanism urging the end cap cover element towards its protracted position, the person has to hold the end cap cover element in its retracted position by providing a force against the action of the spring mechanism until the LED tube is connected to the lamp fixture by means of the connector pin. Since it is hard to connect a LED tube to the lamp fixture with both hands at one end of the LED tube, and it is not a natural movement and therefor inconvenient for the person installing the LED tube to hold the end cap cover element in its retracted position and to operate the switch button at the same time with only one hand at the end cap cover element, the person installing the LED tube is additionally stimulated to first install the LED tube into the lamp fixture and to subsequently operate the switch button to bring the switch into its closed state. Furthermore, when a person removes the LED tube from the lamp fixture, the end cap cover element is slid towards its protracted position under the action of the spring mechanism and the switch is switched by means of the switch opening mechanism into its closed state, such that the safety end cap assembly is returned into its initial state with the connector pin and the switch button covered by the end cap cover element and the switch in its open state. Thus in case the LED tube is removed and subsequently reused, the reduced shock hazard potential still applies.

In a further preferred embodiment of the safety end cap assembly according to the invention the switch button is displaceable between an open position in which the switch is in its open state and a closed position in which the switch is in its closed state. Additionally, the switch opening mechanism comprises a spring mechanism that urges the switch button towards its open position, and a switch button arresting mechanism associated with the end cap cover element and the switch button, which arresting mechanism is configured such that in the retracted position of the end cap cover element the arresting mechanism can arrest the switch button in its closed position and that in the protracted position of the end cap cover element the arresting mechanism cannot arrest the switch button in its closed position.

The feature in this embodiment that the arrest mechanism can arrest the switch button in its closed position in the retracted position of the end cap cover element and cannot arrest the switch button in its closed position in the protracted position of the end cap cover element in combination with the feature that the end cap cover is urged towards its protracted position ensures that the switch is in its open state when the end cap cover element is in its protracted position.

Alternatively, instead of a switch opening mechanism with a spring mechanism that urges the switch button towards its open position and a switch button arresting mechanism, it would also be possible to provide a switch button and an end cap cover element that are configured such that when the switch button is in its closed position and the end cap cover element is displaced from its retracted to its protracted position, the end cap cover element engages the switch button and moves the switch button from its closed position to its open position.

In an advantageous embodiment of the safety end cap assembly according to the invention thereof the switch button arrest mechanism comprises:

a finger associated with the end cap cover element that is displaceable along a path together with the end cap cover element;

a protrusion associated with the switch button that is displaceable along a path together with the switch button;

wherein the path of the finger and the path of the protrusion cross; and the finger and the protrusion are configured such that:

in the retracted position of the end cap cover element the finger is in path of protrusion such that in case in the retracted position of the end cap cover element the switch button is displaced from its open position in its closed position, the protrusion snaps over the finger and the switch button is held its closed position; and that in protracted position of the end cap cover element, the finger is not in path of protrusion.

This embodiment provides a reliable switch button arrest mechanism that is particularly easy to manufacture with a particularly low number of parts.

In a preferred embodiment of the safety end cap assembly including a switch button that is urged into its open position by means of a spring mechanism, the switch comprises an electrode strip extending in the path of the switch button such that when the switch button is displaced from its open position into its closed position, the electrode strip is bent and brought into contact with a contact electrode, wherein the electrode strip provides the spring mechanism by acting as a cantilevered beam urging the switch button from its closed position towards its open position.

This preferred embodiment provides a reliable spring mechanism for the switch button, that is particularly easy to manufacture with a particularly low number of parts.

Alternatively, the function of spring mechanism that urges the switch button towards its open position can be embodied by an element separate from the electrode strips, for instance by a coil spring or by a cantilevered beam type spring.

Furthermore, the switch can also be embodied as a micro-switch unit that is operated by means of the switch button, preferably a micro-switch unit of the normally-open type.

An alternative embodiment of the safety end cap assembly according to the invention wherein the switch button is displaceable between an open position and a closed position:

the switch button comprises an electrically insulating separation wall and an electrically conductive contact element arranged on one side of the separation wall, which electrically conductive contact element is electrically connected to the connector pin, wherein the separation wall is displaceable together with the switch button; and wherein with the switch button in its open position, the separation wall prevents an electrical connection between the electrically conductive contact element connected to the connector pin and an electrically conductive contact element arranged on the opposite side of the separation wall; and with the switch button in its closed position, the separation wall provides a path for electrically connecting the electrically conductive contact element connected to the connector pin to an electrically conductive contact element arranged on the opposite side of the separation wall.

The electrically conductive element arranged on the opposite side of the separation wall may be arranged on the end cap base element. Alternatively, the electrically conductive element arranged on the opposite side of the separation wall may be arranged on the circuit board on which the LEDs of the LED tube are arranged. In both cases the separation wall is arranged between electrically conductive elements arranged on either side of the separation wall.

Providing the switch button with a separation wall arranged between electrically conductive contact elements arranged on either side of the separation wall allows for a mechanical solution with a low amount of moving parts, high tolerances for the dimensions and positioning of the parts of the switch, and easy assembly.

In a particular advantageous embodiment thereof, the separation wall extends in a plane substantially perpendicular relative to the central longitudinal axis of the end cap base element, the electrically conductive element that is electrically connected to the connector pin is arranged on the end cap base element or the end cap cover element, and the electrically conductive element on the other side of the separation wall is arranged on the circuit board on which the LEDs are arranged. This embodiment allows for particularly easy assembly.

In a further preferred embodiment:

the separation wall has arranged on either side thereof an electrically conductive surface, which electrically conductive surfaces are electrically connected, the electrically conductive contact element connected to the connector pin is, at least with the end cap cover element in its retracted position, spring loaded against the separation wall, and with the switch button in its closed position a first of the electrically conductive surfaces is in contact with the electrically conductive contact element connected to the connector pin; and with the switch button in its open position the first of the electrically conductive surfaces is positioned away from the electrically conductive contact element connected to the connector pin.

This embodiment provides a switch which allows for relatively high tolerances for the dimensions and positioning of the parts thereof. The electrically conductive surfaces are advantageously opposite surfaces of an electrically conductive element arranged in a through hole in the separation wall. As described herein above, the electrically conductive contact element arranged on the opposite side of the separation wall may be arranged on the end cap base element. Alternatively, the electrically conductive element arranged on the opposite side of the separation wall may be arranged on the circuit board on which the LEDs of the LED tube are arranged. In both cases the electrically conductive contact element on the opposite side of the separation wall is preferably spring loaded against the separation wall.

In case the electrically conductive element that is connected to the connector pin is arranged on the end cap cover element together with the connector pin, that electrically conductive element is at least in spring-loaded contact with the separation wall when the end cap cover element is in its retracted position. With the end cap cover element in its protracted position, the electrically conductive element that is connected to the connector pin can be positioned away from the separation wall. In case the electrically conductive element that is connected to the connector pin is arranged on the end cap base element together with the connector pin, that electrically conductive element can be in spring-loaded contact with the separation wall permanently.

In an alternative preferred embodiment the separation wall has arranged therein a through hole, wherein:

with the switch button in its closed position the through hole is aligned with the electrically conductive contact element connected to the connector pin to allow the electrically conductive contact element to extend through the through hole; and with the switch button in its open position the through hole is misaligned with the electrically conductive contact element connected to the connector pin.

Relative to the previous embodiment, this particular embodiment allows for the separation wall to be of simple design without electrically conductive surfaces arranged thereon. With the switch button in its closed position the conductive contact element connected to the connector pin is allowed to extend through the through hole to contact an electrically conductive contact element arranged on the opposite side of the switch button directly instead of via electrically conductive surfaces arranged on the switch button. The through hole thus provides a path for the electrically conductive contact element to electrically contact an electrically conductive contact element arranged on the opposite side of the separation wall.

Alternatively, with the switch button in its closed position, instead of the conductive contact element connected to the connector pin, an electrically conductive contact element arranged on the opposite side of the separation wall could extend through the through hole to contact the conductive contact element connected to the at least one connector pin.

In an advantageous embodiment of the safety end cap assembly with a switch button that comprises a separation wall having a through hole allowing the electrically conductive contact element connected to the connector pin to extend through the through hole, the connector pin and the electrically conductive contact element electrically connected therewith are arranged on the end cap cover element, wherein:

- with the end cap cover element in its protracted position the electrically conductive contact element electrically connected to the connector pin is positioned away from the separation wall;
- with the end cap cover element in its retracted position and the switch button in its open position the electrically conductive contact element electrically connected to the connector pin is in spring loaded contact with the separation wall; and
- with the end cap cover element in its retracted position and the switch button in its closed position the electrically conductive contact element electrically connected to the connector pin extends through the through hole in the separation wall.

This embodiment allows to arrange on the opposite side of the separation wall a stationary electrically conductive contact element, that is brought into spring loaded contact with the electrically conductive contact element electrically connected to the connector pin when the end cap cover element is in its retracted position, the switch button is in its closed position, and the electrically conductive contact element electrically connected to the connector pin extends through the through hole in the separation wall. This has the advantage that the electrically conductive contact element on the opposite side of the separation wall away from the connector pin is not in contact with the separation wall. Relative to the previously described embodiment in which both contact elements on either side of the separation wall are designed for spring-loaded contact with the separation wall, this embodiment allows for a simple design of the contact element on one side of the separation wall. The electrically conductive element arranged on the opposite side of the separation wall may be arranged on the end cap base element. Alternatively, the electrically conductive element arranged on the opposite side of the separation wall may be arranged on the circuit board on which the LEDs of the LED tube are arranged.

Since in this embodiment the connector pin and the electrically conductive contact element electrically connected therewith are arranged on the end cap cover element and, with the end cap cover element in its protracted position, the electrically conductive contact element electrically connected to the connector pin is positioned away from the separation wall, the electrically conductive contact element is pulled out of and away from the through hole when the end cap cover element is moved from its retracted position into its protracted position, thus allowing the switch button to be moved from its closed position into its open position. Alternatively, in case the electrically conductive contact element electrically connected to the connector pin is arranged on the end cap base element and is in spring-loaded contact with the separation wall, the free end of the contact element and/or the edge of the though hole could be beveled, such that the electrically conductive contact element extending through the through hole is urged out of the through hole when the switch button is moved from its closed position into its open position.

In a preferred embodiment of the safety end cap assembly according to the invention as described herein above wherein the switch button comprises a separation wall with a through hole through which hole the electrically conductive contact element electrically connected to the connector pin extends when the end cap cover element is in its retracted position and the switch button is in its closed position, the electrically conductive contact element that extends through the through hole in the separation wall, arrests the switch button in its closed position.

This feature makes it possible that there is no separate mechanism needed for arresting the switch button in its closed position while the end cap cover element is in its retracted position.

In an alternative embodiment the arrest mechanism comprises:

- a protrusion associated with the end cap cover element that is displaceable along a path together with the end cap cover element;
- a snap finger associated with the switch button that is displaceable along a path together with the switch button;

wherein

- the path of the snap finger and the path of the protrusion cross; and
- the snap finger and the protrusion are configured such that:
  - in the retracted position of the end cap cover element the protrusion is in the path of the snap finger such that in case in the retracted position of the end cap cover element the switch button is displaced from its open position in its closed position, the snap finger snaps over the protrusion and the switch button is held its closed position; and that
  - in protracted position of the end cap cover element, the protrusion is not in path of the snap finger.

In a further advantageous embodiment of the safety end cap assembly, the end cap cover element is arranged such that the end cap cover element is to be moved in a longitudinal direction parallel to said longitudinal axis to slide the end cap cover element between its protracted position and its retracted position, and the switch button is configured such that for operating the switch button, the switch button is to be moved in a direction different from the longitudinal direction.

The features according to this embodiment reduces the risk that the switch button is accidentally operated when sliding the end cap cover in longitudinal direction. Furthermore, these features make it harder to both hold the end cap cover element in its retracted position and operate the switch button with one hand, in particular in combination with the features of the above described embodiment with the spring mechanism that is configured such that the end cap cover element is urged toward its protracted position. The latter has the advantage that the person installing the LED tube provided with the safety end cap assembly is additionally stimulated to first mount the LED tube in the lamp fixture, such that both hands are free to operate the switch button.

Preferably, the direction in which the switch button is to be moved is a direction perpendicular to said longitudinal direction. Alternatively, the switch button is to be moved in opposite direction relative to the direction in which the end cap cover element is to be moved from its protracted position to its retracted position.

In a further advantageous embodiment, the end cap cover element is arranged such that the end cap cover element is to be moved in a longitudinal direction parallel to said longitudinal axis and in a direction different from said longitudinal direction in order to slide the end cap cover element between its protracted position and its retracted position. These features also make it harder to both hold the end cap cover element in its retracted position and operate the switch button with one hand, in particular in combination with the features of the above described embodiment with the spring mechanism that is configured such that the end cap cover element is urged toward its protracted position. The direction different from said longitudinal direction is for instance a rotation about the longitudinal axis of the end cap base element.

According to a further advantageous development, the safety end cap assembly according to the invention comprises two connector pins and further comprises a protrusion extending parallel to the connector pins and arranged, at least in the retracted position of the end cap cover element, between the two connector pins.

These features effectively prevent mounting of a LED tube having two electrode pins on either end of the LED tube in a light fixture such that the LED tube is mounted in the light fixture with only one connector pin at each end of the LED tube and with the other connector pins positioned outside the light fixture, exposed for hazardous contact. The protrusion can be arranged on the end cap cover element. In that case it is advantageous when the connector pins are arranged on the end cap cover element as well, since the connector pins then prevent the protrusion from breaking off when the end cap cover element is in its protracted position and someone handles the LED tube roughly. Alternatively, the protrusion is arranged on the end cap base element. In the latter case if the end cap cover element has an end wall, a hole is provided therein through which the protrusion can extend when the end cap cover element is in its retracted position.

According to a further advantageous development:

- the end cap cover element comprises a longitudinally extending circumferential wall enclosing an internal space which space is open at one longitudinal end and which space is closed at the other longitudinal end by means of a bottom wall;
- the end cap base element is slidably arranged in said internal space such that said circumferential wall of the end cap cover element is slidable over a wall of the end cap base element having arranged thereon the switch button; and
- the bottom wall of the end cap cover element comprises a hole for slidably receiving the connector pin.

This combination of features provides an end cap cover element, that as a result of the end cap cover element comprising a circumferential wall that is slidable over the external surface at which the switch button is arranged effectively can cover the switch button, is easy to handle by the person operating the end cap cover element by grabbing the circumferential wall. Furthermore, since the end cap cover element slides over the end cap base element and receives the connector pin through a hole in the wall that closes the space in which the end cap base element is received, the end cap cover element is supported such that tilting of the end cap cover element relative to the end cap base element is avoided. The latter has the advantage that it is avoided that the end cap cover element is hindered in its movement from its retracted position to its protracted position. In case more than one connector pin is provided, a respective hole is provided for each connector pin.

According to a further advantageous development the end cap base element comprises a longitudinally extending circumferential wall having said switch button arranged thereon, said circumferential wall enclosing an internal space which space is open at one longitudinal end to slidably receive therein an elongate housing of a LED tube and in which space a circuit board is arranged having mounted thereon the connector pin, wherein the connector pin extends from the end cap base element through the other longitudinal end of the internal space of the end cap base element.

This combination of features provides an end cap base element that can easily be mounted on an elongate housing of a LED tube by sliding an end of said elongate housing in the space enclosed by the circumferential wall and that is easy to manufacture.

In an advantageous embodiment thereof, the end cap base element comprises:

- a circuit board support structure between the longitudinal ends of its internal space for supporting said circuit board; and
- a connector pin support structure at the longitudinal end of its internal space through which the connector extends for support the connector pin at a location along the length thereof.

This combination of features allows for secure and easy mounting of the connector pin in the end cap base element.

Alternatively, the at least one connector can be arranged directly on the end cap base element and connected to the switch for instance by means of a circuit printed on the end cap base element or by means of electrical wires.

The end cap base element and the end cap cover element of the safety end cap according to the invention as described herein above are preferably made of electrically insulating material. Furthermore, the part of the switch button that is exposed via the slot in the end cap cover element when the end cap cover element is in its retracted position are also preferably made of electrically insulating material.

The present invention further relates to a LED tube assembly, comprising:

- an elongate housing having arranged therein LEDs;
- a safety end cap assembly according to the present invention as described herein above arranged on at least one longitudinal end of the housing.

Preferably, the connector pin is electrically connected via the electrical switch of the safety end cap assembly to an electrical circuit comprising the LEDs. Preferably, the LEDs are mounted on a circuit board.

In an advantageous embodiment of the LED tube assembly according to the invention, the LED tube assembly is configured to be fit in a lamp fixture, and the LED tube assembly is configured such that:

with the end cap cover element in its protracted position the LED tube assembly does not fit in said lamp fixture; and with the end cap cover element in its retracted position the LED tube assembly does fit in said lamp fixture.

BRIEF DESCRIPTION OF THE DRAWINGS

The advantages of this invention will be apparent upon consideration of the following detailed disclosure of exemplary non-limiting embodiments of the invention, especially when taken in conjunction with the accompanying drawings wherein.

DETAILED DESCRIPTION OF PREFERRED EMBODIMENTS (AMENDED VS 1)

Figure 1:
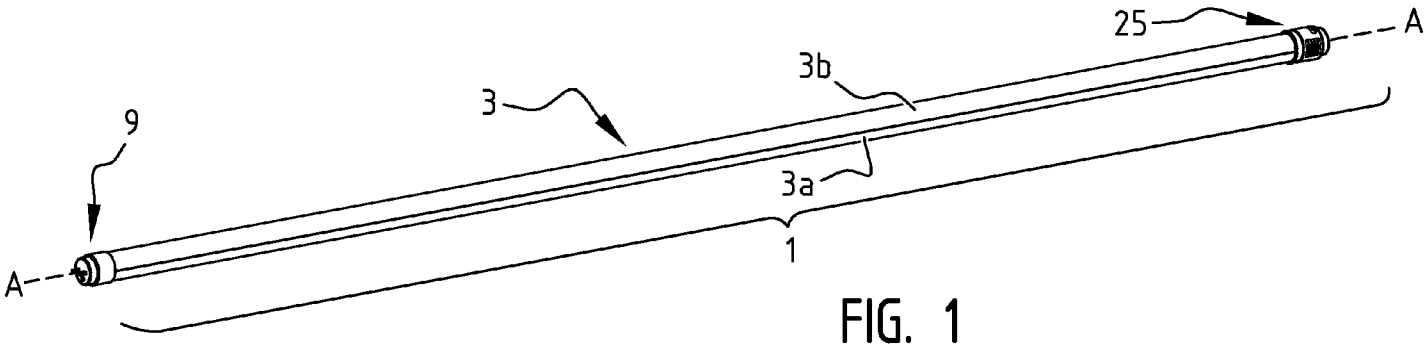
FIG. 1 shows a LED tube having a safety end cap assembly according to the invention in perspective view.
Figure 2:
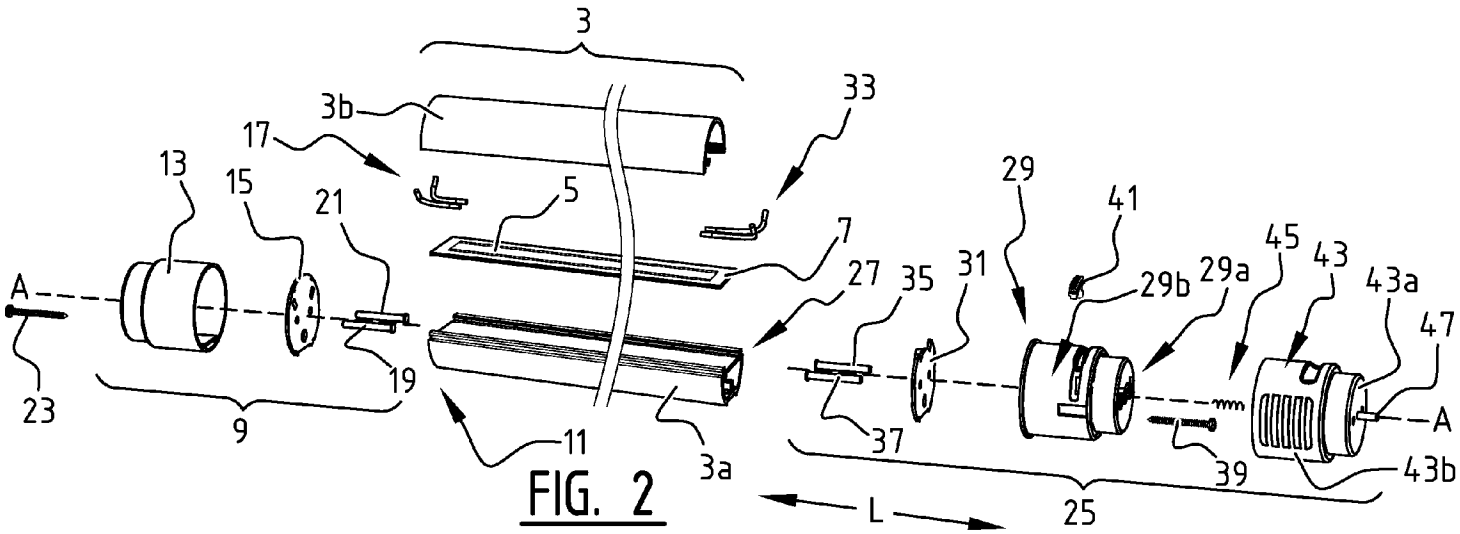
FIG. 2 shows the LED tube of FIG. 1 in exploded view.

In FIGS. 1 and 2 an embodiment of the LED tube assembly 1 according to the invention is shown. In FIG. 1 the LED tube assembly 1 is shown in assembled state, in FIG. 2 in disassembled state, in particular in exploded view.

The LED tube assembly comprises an elongate housing 3 having arranged therein LEDs 5 mounted on a circuit board 7. As shown in FIG. 2 the housing 3 comprises a bottom part 3*a* embodied by elongate profile that serves as a mounting platform for mounting thereon the circuit board 7, and which serves as a heat sink for transferring heat away from the circuit board 7. The bottom part 3*a* is preferably made of Aluminum or an Aluminum alloy. Alternatively, the bottom part is made of a synthetic material, for example polymers. The housing 3 further comprises a top part 3*b* which is translucent or transparent. The top part 3*b* is in assembled state mounted on the bottom part 3*a*, for instance by means of a snap fit, or slide-on connection.

A first end cap assembly 9 is arranged at a first longitudinal end 11 of the housing 3. The first end cap assembly 9 includes a molded plastic cup-shaped body 13 that slides over the first longitudinal end 11 of the housing 3 to secure first end cap assembly 9 to the housing 3. The first end cap assembly 9 further includes a circuit board 15 that in assembled state is arranged in the cup-shaped body 13 and is electrically connected by means of electrical leads 17 to the circuit board 7 on which the LEDs are mounted. The circuit board 15 further serves for mounting thereon two connector pins 19, 21, and includes an electrical circuit arranged for connecting the two connector pins 19, 21 to the electrical leads 17. In assembled state the connector pins 19, 21 protrude through the bottom of the cup-shaped body 13, such that the connector pins 19, 21 extend outwardly in longitudinal direction of the LED tube assembly 1. The connector pins 19 and 21 are thus externally exposed for connecting the LED tube assembly 1 mechanically and electrically to a fixture designed to receive standard-sized fluorescent tubes, such as T5, T8, T10, or T12 tubes. The latter will be explained later with reference to FIGS. 6 to 11. The first end cap assembly 9 is in assembled state secured to the housing 3, in particular the bottom part 3*a*, by means of a screw 23.

A second end cap assembly 25 is arranged at a second longitudinal end 27 of the housing 3. The second end cap assembly 25 is an embodiment of the safety end cap assembly according to the invention. The safety end cap assembly 25 includes an end cap base element 29. In the shown embodiment the end cap base element 29 has a circumferential wall 29*b* that encloses a space. The circumferential wall 29*b* is configured to slide over the second longitudinal end 27 of the housing 3 to secure the safety end cap assembly 25 to the housing 3. The safety end cap assembly 25 further includes a circuit board 31 that in assembled state is arranged in the space enclosed by the circumferential wall 29*b* of the end cap base element 29 and is electrically connected by means of electrical leads 33 to the circuit board 7 on which the LEDs 5 are mounted. The circuit board 31 further serves for mounting thereon two connector pins 35, 37, and includes an electrical circuit arranged for connecting the two connector pins 35, 37 to the electrical leads 33. In assembled state the connector pins 35,37 protrude from the space enclosed by the circumferential wall 29*b* at one longitudinal end 29*a* thereof, such that the connector pins 35, 37 extend outwardly in longitudinal direction of the LED tube assembly 1. The end cap base 29 having arranged therein circuit board 31 is in assembled state secured to the housing 3, in particular the bottom part 3*a*, by means of a screw 39. Alternatively, the end cap base 29 is in assembled state secured to the housing 3 by using alternative means, such as snap-fit connections or adhesive.

The electrical circuit of the circuit board 15 of the first end cap assembly 9, the electrical circuit of the circuit board 7 having mounted thereon the LEDs 5, and the electrical circuit of the circuit board 31 of the safety end cap assembly 25 are designed and electrically connected together as an electrical circuitry that provides a current path between at least one of the connector pins 19, 21 of the first end cap assembly 9 and at least one of the connector pins 35, 37 of the safety end cap assembly 25. The safety end cap assembly 25 further includes an electrical switch. The electrical switch is switchable by means of a switch button 41 between an open state and a closed state. In assembled state the switch button is arranged at the external surface of the circumferential wall 29*b* of the end cap base element 29. The electrical switch is associated with the electrical circuitry formed by the electrical circuit of the circuit board 15 of the first end cap assembly 9, the electrical circuit of the circuit board 7 having mounted thereon the LEDs 5, and the electrical circuit of the circuit board 31 of the safety end cap assembly 25. In the open state the switch opens, i.e. breaks, the electrical circuitry such that there is no current path possible between the connector pins 19, 21 of the first end cap assembly 9 and the connector pins 35, 37 of the safety end cap assembly 25 via the circuit board 7 on which the LEDs 5 are mounted. In the closed state the switch closes the electrical circuitry such that there is a current path possible between the connector pins 19, 21 of the first end cap assembly 9 and the connector pins 35, 37 of the safety end cap assembly 25 via the circuit board 7 on which the LEDs 5 are mounted. A preferred embodiment of the switch will be described under reference to FIGS. 12 to 14.

The safety end cap assembly 25 further includes an end cap cover element 43. In the shown embodiment the end cap cover element 43 has a circumferential wall 43*b* that encloses a space. The circumferential wall 43*b* is configured to slide over the end cap base element 29. In assembled state the end cap cover element 43 is arranged freely slidable between a protracted position and a retracted position along the external surface of the circumferential wall 29*b* of the end cap base element 29 and along the connector pins 35, 37 that extend outwardly from the end cap base element 29 in longitudinal direction L. To allow the end cap cover element 43 to slide along the connector pins 35, 37 holes are provided in the wall 43*a* that closes the space enclosed by the circumferential wall 43*b* at one longitudinal end thereof. A pin shaped protrusion 47 extends outwardly from the bottom wall 43*a* of the end cap cover element 43. The pin shaped protrusion 47 is located in between the two holes for the connector pins 35, 37, and extends along the central longitudinal axis A of the LED tube assembly 1.

Figure 3:
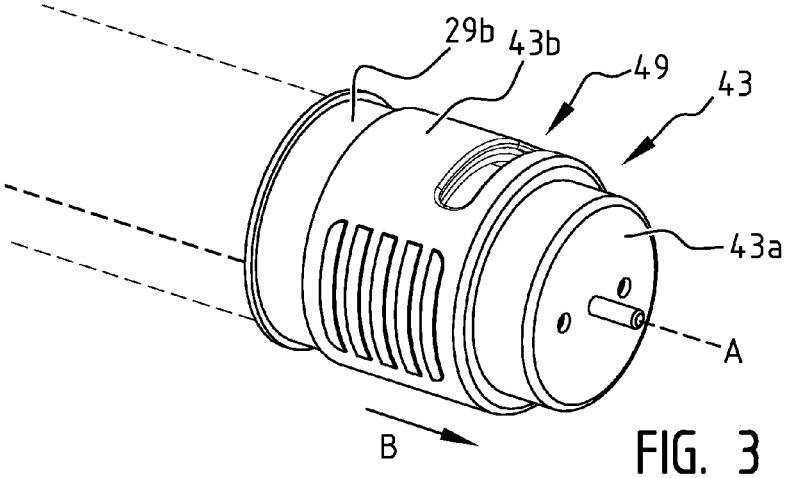
FIGS. 3 to 5 show the safety end cap assembly of the LED tube of FIG. 1 in perspective view and in different positions of the end cap cover element.

In FIG. 3 the end cap cover element 43 is shown in its protracted position, in which it is urged by means of spring 45, which spring pushes the cap cover 43 in de direction of arrow B. A stop (not shown) is provided that prevents the spring 45 pushing the end cap cover element 43 of the end cap base element 29. In the protracted position the switch button 41 is covered by the circumferential wall 43*b* of the end cap cover element 43. Consequently, in the protracted position of the end cap cover element 43, the switch of the safety end cap assembly 25 cannot be operated by handling the switch button 41. Furthermore, in the protracted position of the end cap cover element 43 of the shown embodiment, the connector pins 35, 37 are completely covered by the end cap cover element 43. The connector pins 35, 37 do not extend through the holes in the bottom wall 43*a* of the end cap cover element 43. In the protracted position of the end cap cover element 43 of the shown embodiment, the switch button 41 and the connector pins 35, 37 are not exposed.

Figure 4:
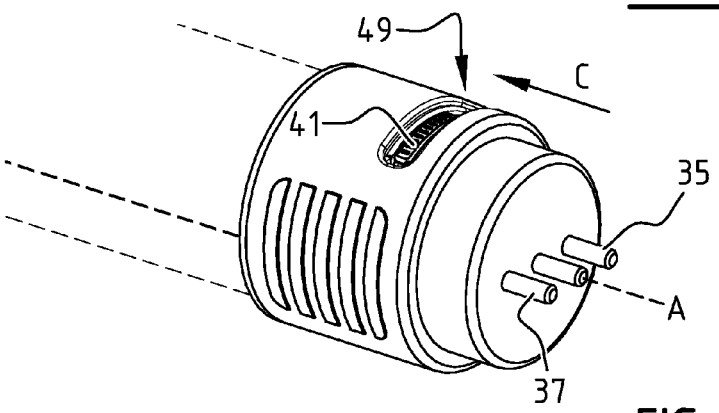

By sliding the end cap cover element 43 in the longitudinal direction C, the end cap cover element 43 is slid along the external surface 29*b* in which the switch button 41 is arranged and along the connector pins 35, 37 from the protracted position shown in FIG. 3 into the retracted position shown in FIG. 4. In the retracted position a slot 49 in the circumferential wall 43*b* of the end cap cover element 43 is aligned with the switch button 41, such that the switch button 41 is exposed for operation. Furthermore, in the retracted position of the end cap cover element 43, the connector pins 35, 37 extend through the holes in the wall 43*a* of the end cap cover element 43, such that the connector pins 35, 37 are exposed. The connector pins 35 and 37 are thus externally exposed for connecting the LED tube assembly 1 mechanically and electrically to a fixture designed to receive standard-sized fluorescent tubes, such as T5, T8, T10, or T12 tubes.

Figure 5:
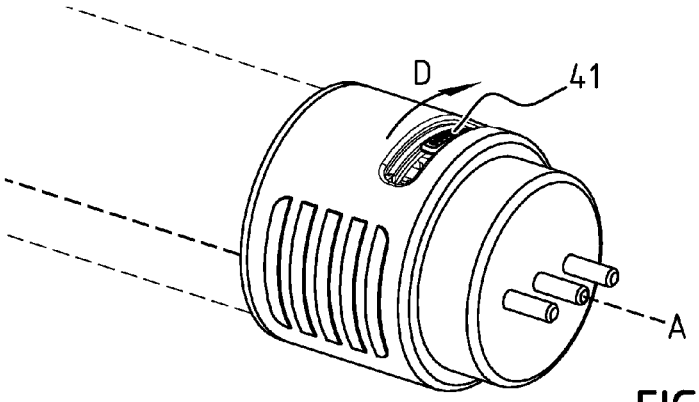

In FIG. 4 the switch button 41 is shown in the position wherein the switch is in its open state. By moving the switch button 41 in the direction of arrow D about the central longitudinal axis A of the LED tube assembly 1, the switch button 41 is moved in to a position in which the switch is in its closed state, which is shown in FIG. 5.

In FIGS. 6 to 10, the mounting of the LED tube assembly 1 in a fixture designed to receive standard-sized fluorescent tubes, such as T5, T8, T10, or T12 tubes is shown in steps.

Figure 6:
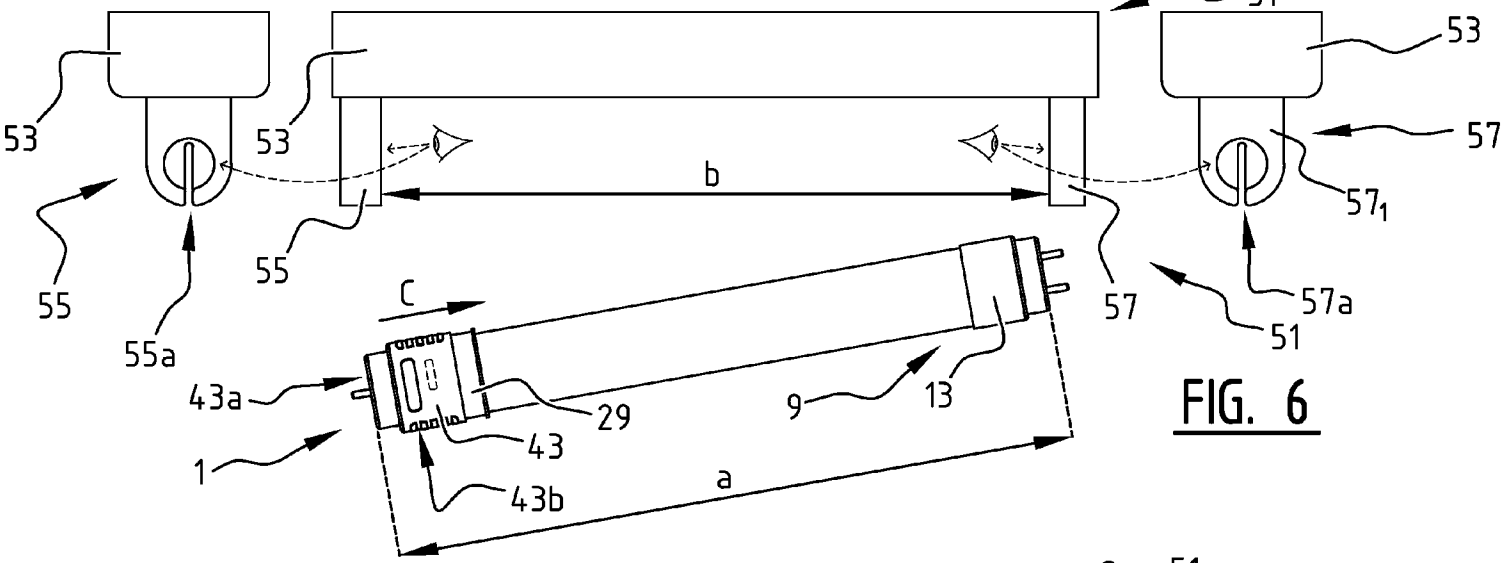
FIGS. 6 to 11 show the mounting of the LED tube of FIG. 1 in a light fixture in side view in subsequent steps.
Figure 7:
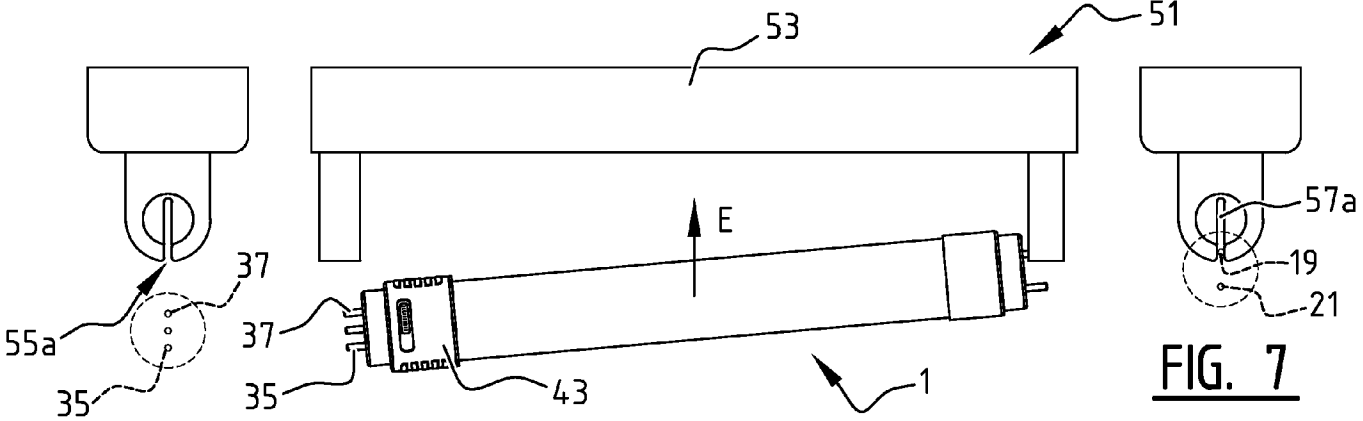

In FIG. 6 a fixture 51 is shown including a fixture base 53 and two spaced apart lamp holders 55 and 57. The lamp holders 55, 57 both include a slot 55*a*, 57*a* for receiving the connector pins 19, 21, 35, and 37 of the LED tube assembly 1. The LED tube assembly 1 is shown with the safety end cap 25 in its protracted position. Since in the protracted position the end cap cover element 43 covers the connector pins 35 and 37, it is not possible to mount the LED tube assembly 1 in the fixture 51 with the end cap cover element 43 in its protracted position. Furthermore, with the end cap cover element 43 in its protracted position the distance a between the end face of the end cap cover element 43 and the end face of the cup-shaped body 13 of the first end cap assembly 9 is larger than the distance b between the lamp holders 55 and 57, such that with the end cap cover element 43 in its protracted position the LED tube assembly 1 does not fit between the lamp holders 55 and 57. By sliding the end cap cover element 43 in the direction of arrow C, the end cap cover element 43 is brought in its retracted position as shown in FIG. 7. By sliding the end cap cover element 43 in the direction of arrow C toward the end cap base element 29 the distance a is reduced such that the distance a is smaller than distance b, and the connector pins 35, 37 are exposed. The distance a is in the present embodiment the relevant length of the LED tube assembly 1, i.e. the distance between elements at the ends of the LED tube assembly 1 that is relevant for fitting the LED tube assembly 1 in the light fixture 51. For sliding the end cap cover element 43 in the direction of arrow C in to its retracted position, the person installing the LED tube assembly 1 can advantageously grab the end cap cover element 43 at its longitudinally extending circumferential wall 43*b*. The person does not have to push against the bottom wall 43*a* of the end cap cover element 43. By grabbing the end cap cover element 43 at its longitudinally extending circumferential wall 43*b* contact with the connector pins 35, 37 is avoided. As shown in FIG. 6 circumferential wall 43*b* is provided with ribs to enhance the grip on the circumferential wall 43*b* and stimulate the person to grab the circumferential wall 43*b*. These ribs are optional.

Figure 8:
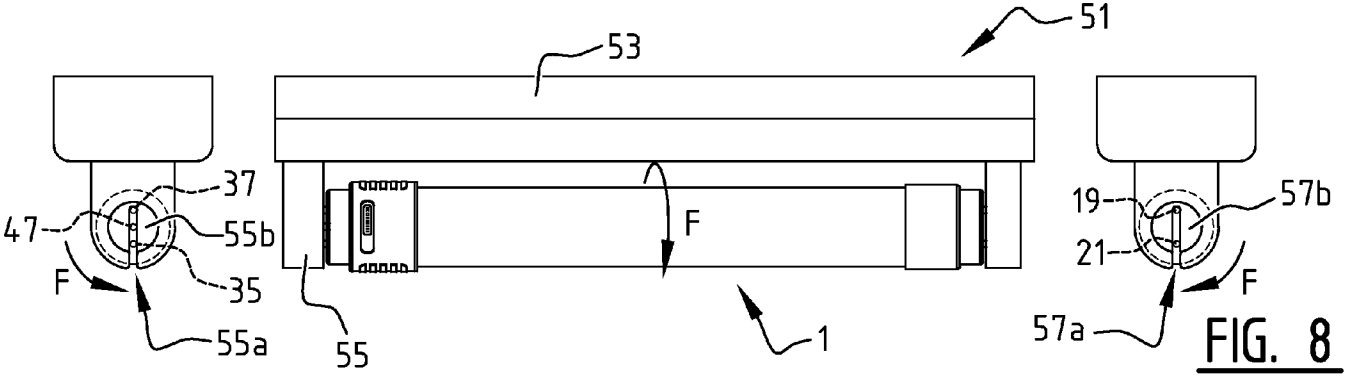
Figure 9:
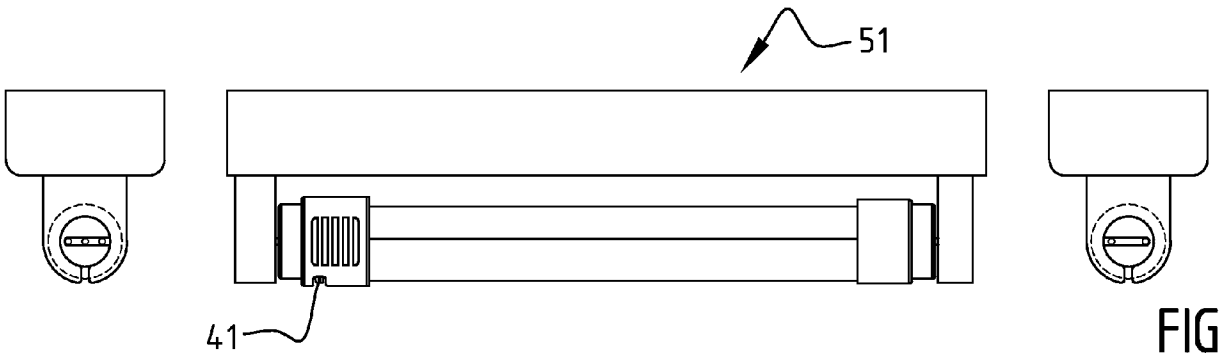

Subsequently, the connector pins 19, 21, 35, and 37 can be slid into the slots 55*a* and 57*a* by moving the LED tube assembly 1 in direction of arrow E, such that the situation results that is shown in FIG. 8, in which the connector pins 19, 21, 35, and 37 are fully inserted in a part of the slots 55*a*, 57*a*, that is formed in parts 55*b* and 57*b* of the lamp holders 55 and 57 that are rotatable in the direction of arrow F. By subsequently rotating the LED tube assembly 1 in the direction of arrow F, the situation as shown in FIG. 9 results, in which the LED tube assembly 1 is mechanically connected to the fixture 51 by means of the connector pins 19, 21, 35, and 37. In the situation shown in FIG. 9, the connector pins 19, 21, 35, and 37 are in contact with electrical contacts inside the lamp holders 55, 57, such that the LED tube assembly is also electrically connected to the fixture 51.

Figure 10:
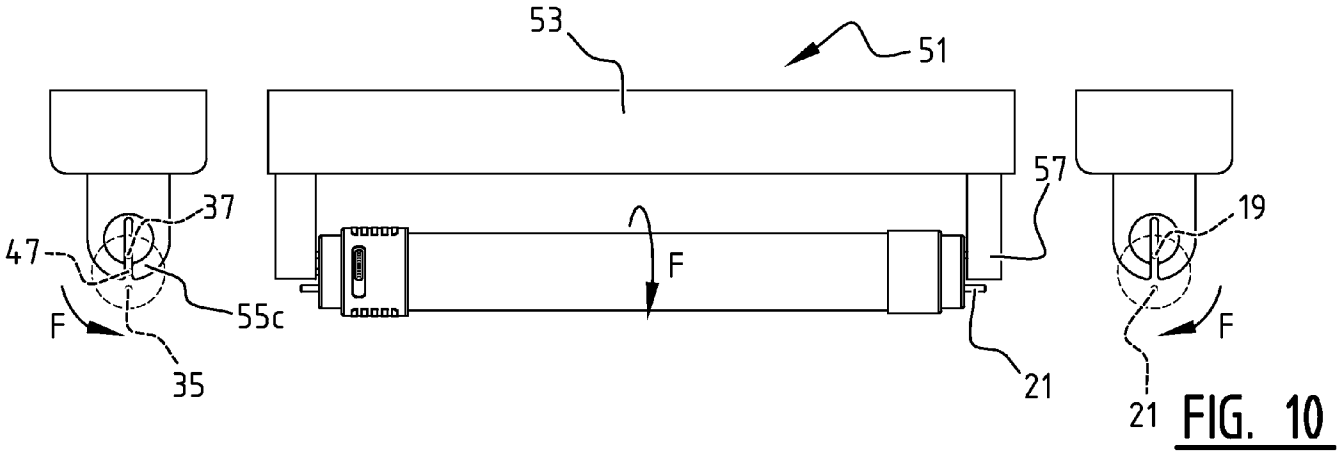

In FIG. 10 a situation is shown wherein connector pins 19 and 37 are inserted in the respective rotatable parts 55*b*, 57*b* of the lamp holders 55, 57, while the connector pins 21 and 35 are not inserted into the lamp holders 55, 57 at all. In case the person installing the LED tube assembly 1 would try to rotate the LED tube assembly 1 in the direction of arrow F in the shown situation, the pin-shaped protrusion 47 prevents rotation of the LED tube assembly 1 in the direction of arrow F by contacting the stationary part 55*c* of lamp holder 55. As result it is prevented that the LED tube assembly 1 is rotated in the direction of arrow F in such a way that the connector pins 19 and 37 come into contact with contacts in the lamp holders 55 and 57 that in case the LED tube assembly 1 was fully inserted in the lamp holders would contact the connector pins 21 and 35.

Figure 11:
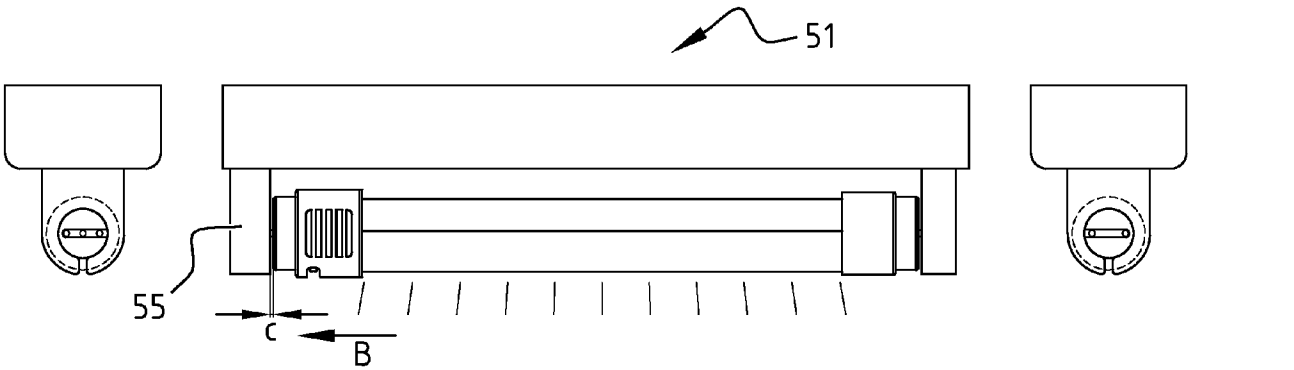

In the situation shown in FIG. 9, in which the LED tube assembly 1 is mechanically and electrically connected to the fixture 51 and in which the end cap cover element 43 is in its retracted position, the exposed switch button 41 can be operated to switch the switch of the safety end cap 25 from its open state to its closed state. The circuitry electrically connecting the connector pins 19, 21, 35, 37 and the LEDs 5 mounted on circuit board 7 is then closed, such that a current path is formed between the connector pins 19, 21, 35, 37, via which the LEDs 5 can be powered by means of a power source connected to the fixture 51 as shown in FIG. 11.

Since the spring 45 urges the end cap cover element 43 in the direction of arrow B towards its protracted position, the end cap cover element 43 is slid in the direction of arrow B when the person mounting the LED assembly 1 in the fixture 51 releases the end cap cover element 43. In the situations shown in FIGS. 8, 9, and 11, the end cap cover element 43 can only slide in the direction of arrow B to fill the gab c between the bottom wall 43*a* of the end cap cover element 43 and the lamp holder 55. As a result, in the situations shown in FIGS. 8 to 11, after releasing the end cap cover element 43, the fixture 51 prevents the end cap cover element 43 reaching its protracted position. In case after mounting of the LED tube assembly 1 in the fixture 51, the LED tube assembly is removed from the fixture 51 by releasing the connector pins 19, 21, 35, and 37 from the lamp holders 55, 57, the fixture 51 does not longer prevent the end cap cover element 43 to be slid in the direction of arrow B. consequently, after removal of the LED tube assembly 1 from the fixture, the end cap cover element 43 is slid into its protracted position under action of spring 45.

The safety end cap assembly 25 further includes a switch opening mechanism configured such that in case the switch is in its closed state and the end cap cover element 43 is slid into its protracted position the switch is automatically switched to its open state. Thus when after removal as described herein above the end cap cover element 43 is slid into its protracted position under action of spring 45, the switch is returned to its open state in which the circuitry electrically connecting the connector pins 19, 21, 35, 37 and the LEDs 5 is open, i.e. broken.

Figure 12:
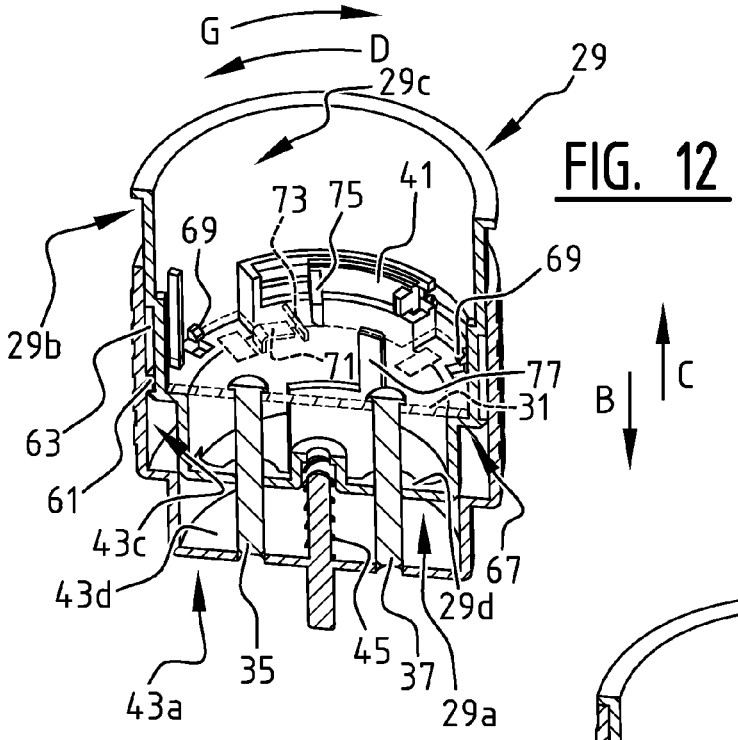
FIGS. 12 to 14 show the safety end cap assembly of FIGS. 3 to 5 in section view.
Figure 13:
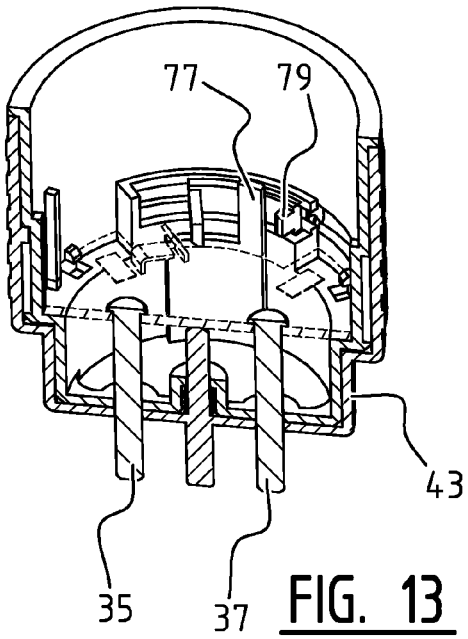
Figure 14:
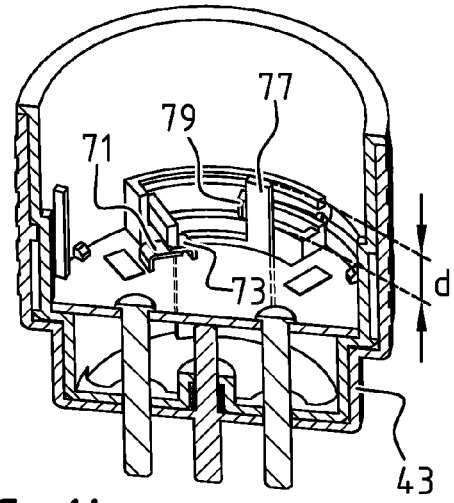

An embodiment of this switch opening mechanism is described under reference to FIGS. 12 to 14, in which the safety end cap assembly of FIGS. 3 to 5 is shown in a longitudinal section view.

In FIG. 12 the end cap cover element 43 is shown in its protracted position, in which position it is urged by means of spring 45, which spring 45 pushes the end cap cover element 43 in de direction of arrow B. An inwardly extending protrusion 61 arranged on the internal surface 43*c* of the circumferential wall of the end cap cover element 43, extends in a recess 63 in the circumferential wall of end cap base 29 to act as a stop for preventing the spring 45 pushing the end cap cover element 43 of the end cap base 29. The switch button 41 is freely slidable mounted on the internal surface 29*c* of the circumferential wall 29*b* of the end cap base element 29 and extends through a slot (not shown) in the circumferential wall of the end cap base element 29, such that the switch button 41 is arranged at the external surface of the circumferential wall of the end cap base element 29 to enable operation thereof. The circuit board 31 on which the connector pins 35, 37 are mounted is arranged in the end cap base element 29 and is supported by a stepped portion 67 of the circumferential wall 29*b* of the end cap base element 29 and is secured by means of inwardly extending noses 69 arranged on the internal surface of the circumferential wall of the end cap base element 29. At one longitudinal end 29*a* of the end cap base element 29 the connector pins 35 and 37 extend through holes in a bridge shaped bottom wall 29*d* for support in lateral direction. In the protracted position of the end cap cover element 43 of the shown embodiment, the connector pins 35, 37 are completely covered by the end cap cover element 43. The connector pins 35, 37 do not extend through the holes in the wall 43*a* of the end cap cover element 43.

On the circuit board 31 two electrode strips 71, 73 are arranged that are part of the switch of the safety end cap assembly 25. The electrode strips 71, 73 are part of the electronic circuit of the circuit board 31. In FIG. 12 the electrode strips 71, 73 are not in contact, such that a current path in the electronic circuit of the circuit board 31 is open, i.e. broken. The switch is in its open state. The electrode strip 73 extends in the path of an inward extending protrusion 75 arranged on the switch button 41. When the switch button 41 is moved in the direction of arrow D the protrusion 75 of switch button 41 is brought into contact with the electrode strip 73 such that the electrode strip 73 is pushed down and brought into contact with electrode strip 71. The opened current path in the electronic circuit of the circuit board 31 is thus closed. The switch is then in its closed state. Operation of the switch button 41 is however not possible in the protracted position of the end cap cover element 43, since the switch button 41 is covered by the end cap cover element 43 and is not externally exposed, as described under reference to FIGS. 3 to 5. In an alternative arrangement, a plurality of electrode strips 71 are arranged next to each other and a plurality of electrode strips 73 are arranged next to each other, and the inward extending protrusion 75 is longer, such that it engages the plurality of electrode strips 73 at the same time. In another alternative arrangement, two electrode strips are arranged beside each other and the inward extending protrusion 75 is of an electrically conductive material, such that when the protrusion 75 is brought in engagement with the electrode strips, the electrode strips are electrically connected. Although in FIG. 12 the electrode strips 71, 73 are arranged on a circuit board that extends in a plane perpendicular to the longitudinal axis A of the end cap base element, the electrode strips 71, 73 are alternatively arranged on a circuit board that extends in a plane parallel to the longitudinal axis A of the end cap base element.

As shown in FIG. 12 a finger 77 is arranged on the internal surface 43*d* of the wall 43*a* of the end cap cover element 43, which finger 77 extends in longitudinal direction. By sliding the end cap cover element 43 in the longitudinal direction C, the end cap cover element 43 is slid along the external surface of the circumferential wall 29*b* in which the switch button 41 is arranged and along the connector pins 35, 37 from the protracted position shown in FIG. 12 into the retracted position shown in FIG. 13. As described under reference to FIGS. 3 to 5 in the retracted position a slot in the circumferential wall 43*b* of the end cap cover element 43 is aligned with the switch button 41, such that the switch button 41 is externally exposed for operation. By sliding the end cap cover element 43 in the longitudinal direction C the finger 77 that is arranged on the internal surface 43*d* of the wall 43*a* of the end cap cover element 43, is also slid in direction of arrow C. As shown in FIG. 13, in the retracted position of the end cap cover element 43 the finger 77 is in the path of a snap element 79 that is arranged on the switch button 41 and that extends inwardly. When sliding the switch button 41 in the direction of arrow D from the situation shown in FIG. 13, the snap element 79 is brought into contact with the finger 77 and snaps over the finger 77.

While moving the switch button 41 in the direction of arrow D the protrusion 75 is brought into contact with the electrode strip 73 such that the electrode strip 73 is pushed down and brought into contact with electrode strip 71. The opened current path in the electronic circuit of the circuit board 31 is thus closed. The switch is then in its closed state. The result is the situation shown in FIG. 14.

When pushed down the electrode 73 is bent and as a result of its elastic properties acts as a cantilevered beam pushing the switch button 41 back in the direction of arrow G. Although the electrode strip 73 pushes the switch button 41 back in the direction of arrow G, the snap element 79 and the finger 77 prevent that the switch button 41 moves in the direction of arrow G. Consequently, the switch remains in its closed state even when the person operating the switch button 41 does not hold the switch button in the position shown in FIG. 14. In case the end cap cover element 43 is not held in the retracted position shown in FIG. 14, the spring 45 will push the end cap cover element 43 in the direction of arrow B. As a result the finger 77 will also move in the direction of arrow B. After the end cap cover element 43 has slid in the direction of arrow B over a distance d, the finger 77 and the snap element 79 loose contact and the electrode strip 73 is allowed to push the switch button 41 back in the direction G. The contact between the electrode strips 71 and 73 is then lost, such that the switch is returned in its open state. The result is the situation as shown in FIG. 12, wherein the end cap cover element 43 is in its protracted position, and the switch is in its open state.

Thus in the situation shown in FIG. 11, as long as the distance d as described herein above is larger than the gap c, the switch remains in its closed state while the LED tube assembly 1 is mounted in the fixture 51. Once the LED tube assembly is removed from the fixture 51, the spring 45 is allowed to push the end cap cover element 43 into its retracted position, in which, as shown in FIG. 12 the finger 77 and the snap element 79 are no longer in contact and the switch is in its open state. Consequently, when removing the LED tube assembly from the fixture, the end cap cover element 43 is returned into its protracted position and the switch is returned in its open state.

In FIGS. 15 to 19 an alternative embodiment of the safety end cap assembly of FIGS. 1 to 14 is shown.

The safety end cap assembly 100 includes an end cap base element 101. In the shown embodiment the end cap base element 101 has a circumferential wall 101*b* that encloses a space. The circumferential wall 101*b* is configured to slide over the second longitudinal end 27 of the housing 3 shown in FIG. 2 to secure the safety end cap assembly 100 to the housing 3.

Figure 15A:
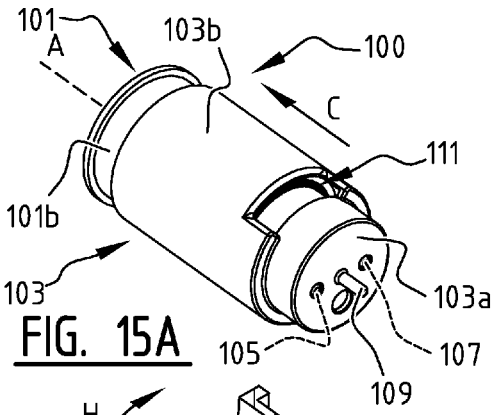
FIGS. 15 to 19 show an alternative embodiment of the safety end cap assembly of FIGS. 1 to 14.
Figure 15B:
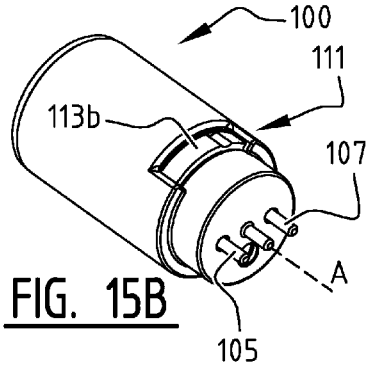

The safety end cap assembly 100 further includes an end cap cover element 103. In the shown embodiment the end cap cover element 103 has a circumferential wall 103*b* that encloses a space. The circumferential wall 103*b* is configured to slide over the end cap base element 101. In assembled state the end cap cover element 101 is arranged freely slidable along the external surface of the circumferential wall 101*b* of the end cap base element 101 and along the connector pins 105, 107 that extend outwardly from the end cap base element 101 between a protracted position and a retracted position. To allow the end cap cover element 103 to slide along the connector pins 105, 107 holes are provided in the wall 103*a* that closes the space enclosed by the circumferential wall 103*b* at one longitudinal end thereof. A pin shaped protrusion 109 extends outwardly from the bottom wall 103*a* of the end cap cover element 103. The pin shaped protrusion 109 is located in between the two holes for the connector pins 105, 107, and extends along the central longitudinal axis A of the end cap cover element 103. In FIG. 15A the end cap cover element 103 is shown in its protracted position, in which the connector pins 105, 107 are completely covered by the end cap cover element 103. The connector pins 105, 107 do not extend through the holes in the bottom wall 103*a* of the end cap cover element 103. Between the end cap cover element 103 and the end cap base element 101 a coil spring 106 is arranged that urges the end cap cover element 103 into its protracted position. By sliding the end cap cover element 103 in the longitudinal direction C against the force exerted by the coil spring 106, the end cap cover element 103 is slid along the external surface 101*b* of the end cap base element 101 into its retracted position, in which the connector pins 105, 107 extend through the holes in the wall 103*a* of the end cap cover element 103, such that the connector pins 105, 107 are exposed. In the circumferential wall 103*b* of the end cap cover element 103 a slot 111 is arranged. As shown in FIG. 15B, in the retracted position, the slot 111 is aligned with a switch button 113, such that the switch button 113 is exposed for operation. As shown in FIG. 15A, in the protracted position of the end cap cover element 103, the slot 111 is not aligned with a switch button 113, such that the switch button 113 is covered by the end cap cover element 103.

So far, the safety end cap assembly 100 corresponds in construction and operation with the safety end cap assembly 25 shown in FIGS. 1 to 14.

In FIGS. 16 to 19 the safety end cap assembly 100 is shown in a sectional view, such that the components inside of the safety end cap assembly 100 are exposed, as well as the arrangement thereof. In particular the electrical switch and the switch opening mechanism are embodied alternatively relative to the safety end cap assembly 25 shown in FIGS. 12 to 14.

Figure 16:
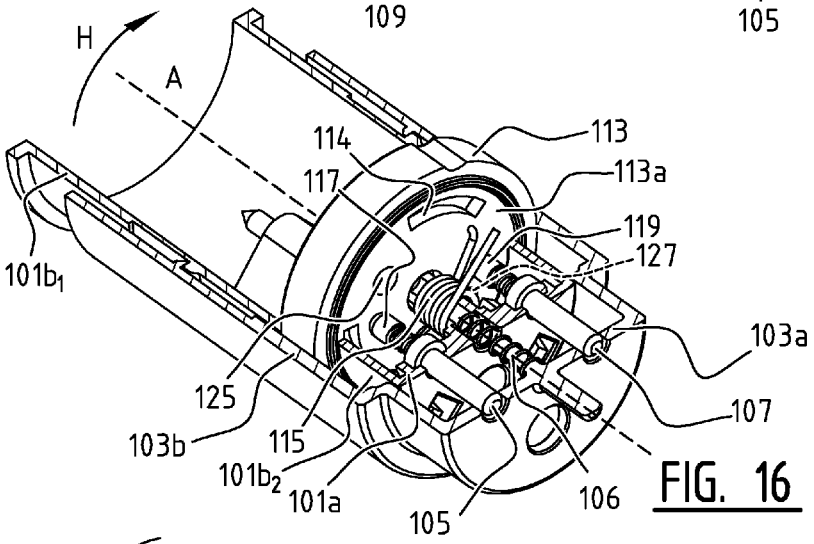

In safety end cap assembly 100 the switch button 113 is a disk-shaped element that is mounted on the end cap base element 101 and is rotatable around the central longitudinal axis A of the end cap cover element 103. In particular the switch button 113 is arranged between two parts of the end cap base element, a bottom part 101$b_1$ and a top part 101$b_2$. The bottom part and top part are interconnected via connecting members (not shown) that extend through slots 114 in the switch button 113. A torsion spring 115 is mounted on the end cap base element 101 around the central longitudinal axis A and is engaged with the switch button 113 such that the switch button 113 is urged in the direction of arrow H towards the open position of the switch button 113. Connector pins 105 and 107 are arranged on the end wall 101*a* of the end cap base element 101. Each connector pin 105, 107, is electrically connected to a respective electrically conductive contact element 117, 119. Arranged between each connector pin 105, 107 and the associated contact element 117, 119 is a respective coil spring 121, 123 that urges the associated contact element 117, 119 in the direction of arrow I against the front surface 113*a* of the switch button 113. On the front surface 113*a* of the switch button 113 an electrically conductive surface 125 is arranged. As shown in FIG. 16, in the open position of the switch button 113, the electrically conductive surface 125 is not in contact with the contact element 117. A second electrically conductive surface 127 is arranged on the front surface 113*a* of the switch button 113 on the opposite side of the central longitudinal axis A. In the open position of the switch button 113, the electrically conductive surface 127 is not in contact with the contact element 119.

Figure 17:
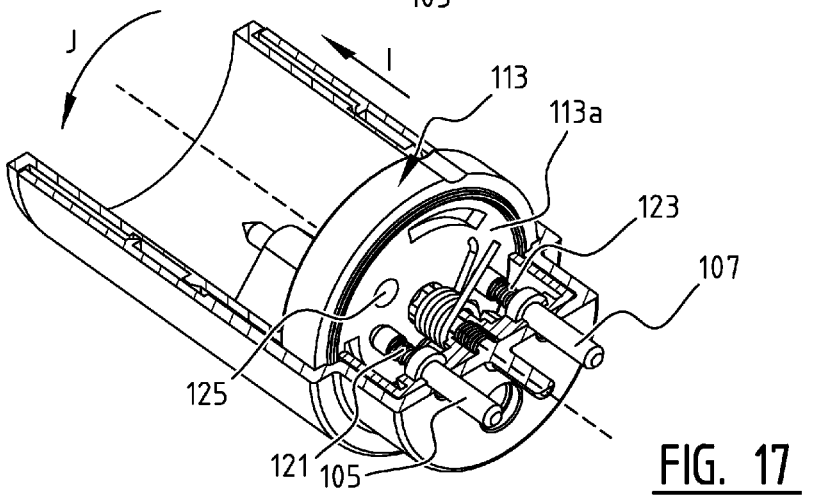
Figure 18:
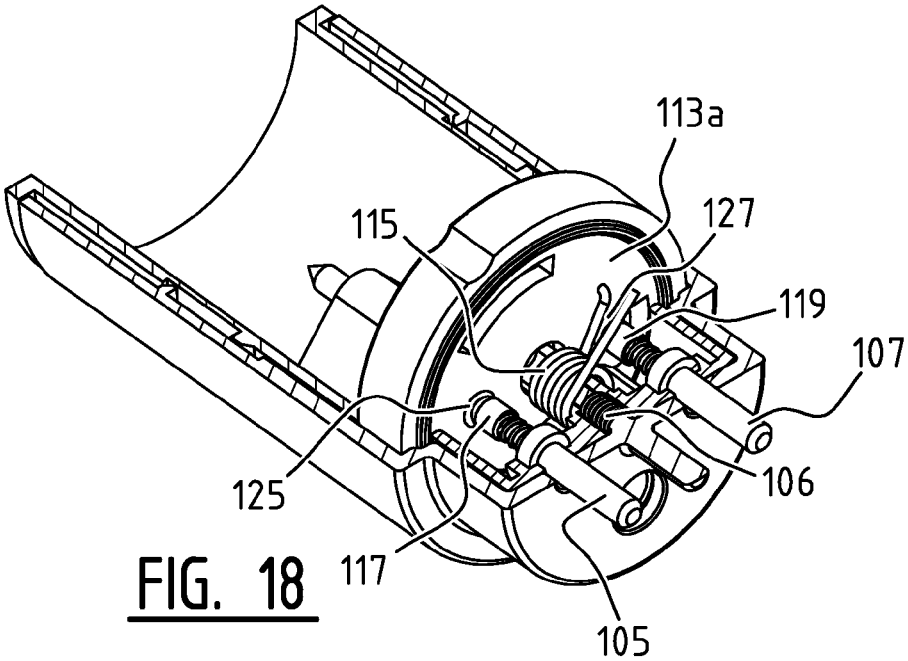

When the end cap cover element 103 is moved into its retracted position shown in FIG. 15B and FIG. 17, the connector pins 105 and 107 are exposed. Furthermore, as shown in FIG. 15B, a part of the side surface 113*b* of the switch button 113 is exposed by the slot 111, such that the switch button 113 can be operated by engaging the side surface 113*b* of the switch button 113 and rotating the switch button 113 in the direction of arrow J against the force exerted by the torsion spring 115 on the switch button 113. As a result the electrically conductive surfaces 125 and 127 on the front surface 113*a* of the switch button 113 are rotated around the central longitudinal axis A, such that as shown in FIG. 18, the electrically conductive surface 125 comes into contact with the contact element 117 and the electrically conductive surface 127 comes into contact with the contact element 119. In FIG. 18 the switch button 113 is in its closed position.

Figure 19:
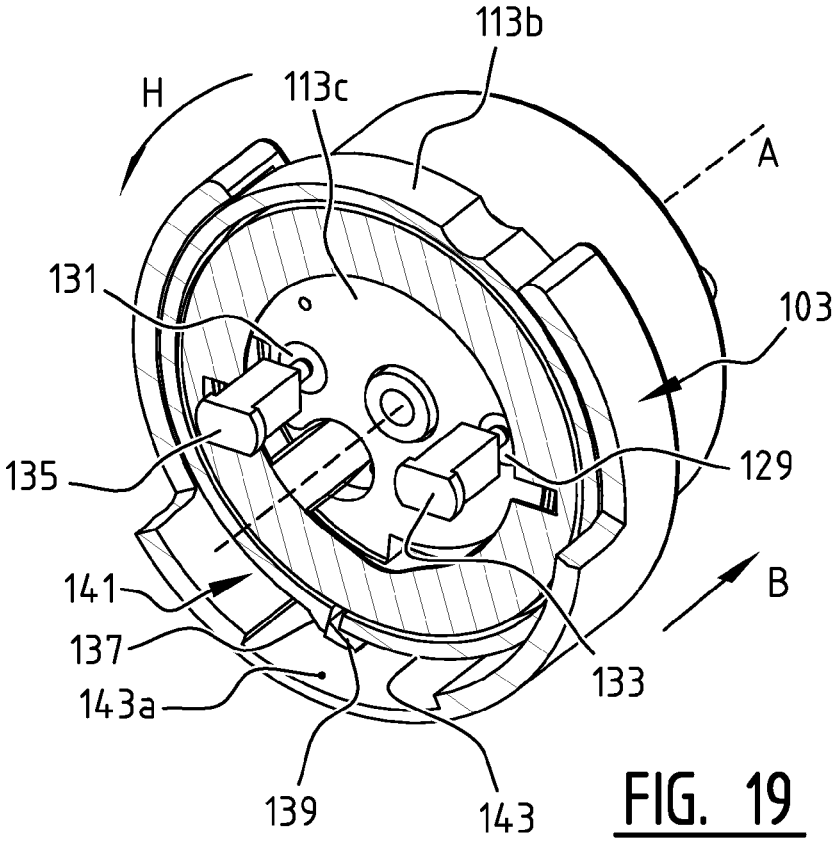

FIG. 19 shows the rear side of the switch button 113 as shown in FIG. 18, i.e. the rear side of the switch button 113 in its closed position.

As shown in FIG. 19 two electrically conductive surfaces 129, 131 are arranged on the rear surface 113*c* of the switch button 113. Each electrically conductive surface 129, 131, is electrically connected with a respective electrically conductive surface 125, 127 on the front surface 113*a* of the switch button 113: electrically conductive surface 129 with electrically conductive surface 125, and electrically conductive surface 131 with electrically conductive surface 127. In particular electrically conductive surfaces 125 and 129 are opposite surfaces of a first electrically conductive element arranged in the switch button 113, and electrically conductive surfaces 127 and 131 are opposite surfaces of a second electrically conductive element arranged in the switch button 113. As shown in FIG. 19 each electrically conductive surface 129, 131, arranged on the rear surface 113*c* of the switch button 113 is in contact with a respective electrically conductive contact element 133, 135. These electrically conductive contact elements 133, 135 are arranged on the circuit board 7 shown in FIG. 2 as a replacement of electrical leads 33. The electrically conductive contact elements 133, 135 are spring loaded against the rear surface 113*c* of the switch button 113.

Thus, in the closed position of the switch button 113, shown in FIGS. 18 and 19, connector pin 105 is electrically connected to electrically conductive contact element 133 via electrically conductive coil spring 121, electrically conductive contact element 117, electrically conductive surface 125, and electrically conductive surface 129, while connector pin 107 is electrically connected to electrically conductive contact element 135 via electrically conductive coil spring 123, electrically conductive contact element 119, electrically conductive surface 127, and electrically conductive surface 131. Consequently, in the closed position of the switch button the connector pins 105, 107 are in electrical contact with the circuitry on the circuit board 7 shown in FIG. 2. In the closed position of the switch button 113, the electrical switch, of which the switch button 113 is a component, is in its closed state.

The switch button 113 thus provides a separation wall, which in the open position of the switch button 113 electrically separates the contact elements that are arranged on opposite sides thereof.

As shown in FIG. 19, on the outside surface of the switch button 113 an outwardly protruding nose-shaped retention element 137 is arranged, that cooperates with an inwardly protruding nose-shaped retention element 139 arranged on the inner surface of the end cap cover element 103. The two nose-shaped retention elements 137, 139 engage each other to prevent that switch button 113, which is urged in the direction of arrow H towards the open position of the switch button 113 by torsion spring 115, rotates in the direction of arrow H. The nose-shaped retention element 137 is arranged on the free end of a snap-finger 141 formed integrally with the switch button 113 at its circumference. The nose-shaped retention elements 139 is arranged in a slot 143 arranged on de inside of the circumferential wall 103*b* of the end cap cover element, in which slot 143 the nose-shaped retention elements 137 extends.

As shown, the nose-shaped retention elements 139 extends in longitudinal direction over only a part of the length of the slot 143. As a result, if the end cap cover element 103 is moved in the direction of arrow B towards its protracted position under influence of the coil spring 106, the nose-shaped retention element 139 is moved relative to the nose-shaped retention element 137 in the direction of arrow B. When the nose-shaped retention element 137 has entered the part 143*a* of the slot in which the nose-shaped retention element 139 does not extend, the nose-shaped retention elements 137, 139 do no longer engage each other and the switch button 113 is no longer retained in its closed position. Under influence of the torsion spring 115, the switch button 113 is then rotated in the direction of arrow H into its open position. As a result the electrically conductive surfaces 125, 127, 129, 131 on the front and rear surfaces of the switch button 113 are also rotated in the direction of arrow H, such that the electrically conductive surfaces 125, 127, 129, 131 are no longer in contact with the respective contact elements 117, 119, 133, 135. The electrical switch of which the switch button 113 is a component is then in its open state in which the connector pins 105 and 107 are no longer electrically connected with the electrically conductive contact elements 133, 135 on the circuit board 7.

With the switch button 113 in its open position and the end cap cover element 103 in its retracted position, the nose-shaped retention elements 137 and 139 are positioned with their respective slanting surfaces facing each other. If starting from that situation the switch button 113 is moved into its closed position, the slanting surface of the nose-shaped retention element 137 is pushed against slanting surface of the nose-shaped retention element 139, such that the nose-shaped retention element 137 at the end of snap finger 141 snaps over the nose-shaped retention element 139. This results in the situation shown in FIG. 19, in which the nose-shaped retention element 137 and 139 engage each other such that the switch button 113 is retained in its closed position.

In FIGS. 20 to 24 an alternative embodiment is shown of the safety end cap assembly 100 as shown in FIGS. 15 to 19. Many of the components of the safety end cap assembly 200 shown in FIGS. 20 to 24 correspond to components of the safety end cap assembly 100, albeit that the arrangement of components is different. In the following description and in the figures of the safety end cap assembly 200 corresponding components have the same reference sign, albeit that the reference sign is in the 200-range instead of the 100-range. Furthermore, the working principle of the safety end cap assembly 200 is essentially the same as the working principle of the safety end cap assembly 100. Therefore, in the following description only the differences between the safety end cap assembly 100 and the safety end cap assembly 200 will be discussed.

Figure 20A:
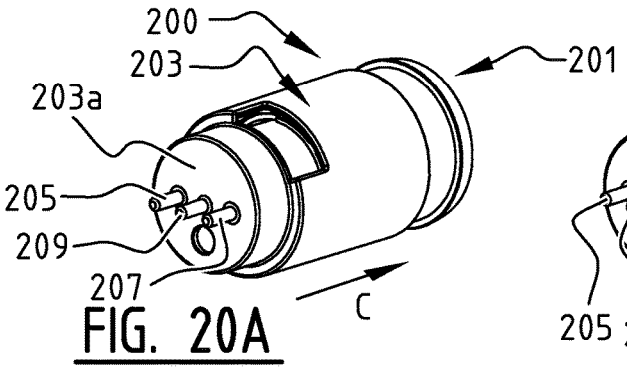
FIGS. 20 to 24 show an alternative embodiment of the safety end cap assembly of FIGS. 15 to 19.
Figure 20B:
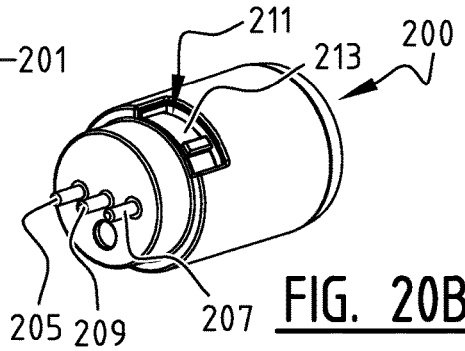

One of the main differences between the safety end cap assembly 100 and the safety end cap assembly 200 is that the connector pins 205 and 207 and associated coil springs 221, 223, and contact elements 217, 219 are arranged on the end cap cover element 203 instead of on the end cap base element 201. As a result, as shown in FIGS. 20A and 20B that show safety end cap assembly 200 with its end cap cover element 203 in the protracted and retracted position, respectively, both in the protracted as in the retracted position of the end cap cover element 203, the connector pins 205 and 207 are not covered by the end cap cover element 203 and thus exposed. Although in the protracted position of the end cap cover element 203 the connector pins 205, 207, are exposed, when arranged on the LED-tube 1 as shown in FIGS. 1 to 11 instead of safety end cap assembly 25, it remains impossible to fit the LED-tube between the lamp holders 55 and 57 with the end cap cover element 203 in its protracted position since, as shown in FIG. 6, with the end cap cover element 203 in its protracted position the distance a between the end face of the end cap cover element 203 and the end face of the cup-shaped body 13 of the first end cap assembly 9 is larger than the distance b between the lamp holders 55 and 57. The pin shaped protrusion 209 is located in between the two connector pins 205, 207.

Figure 21A:
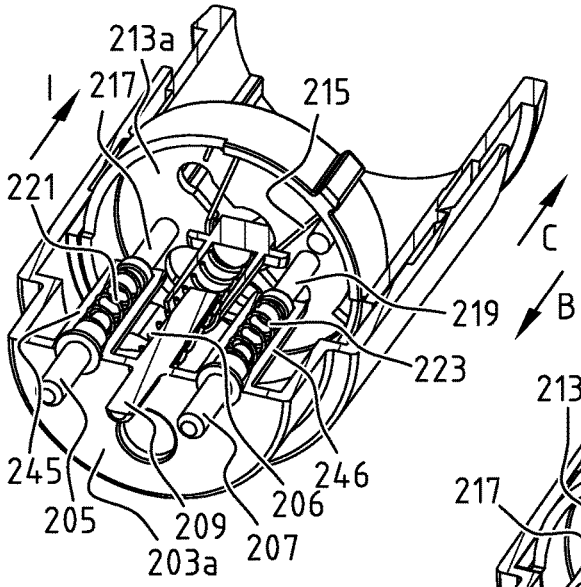
Figure 21B:
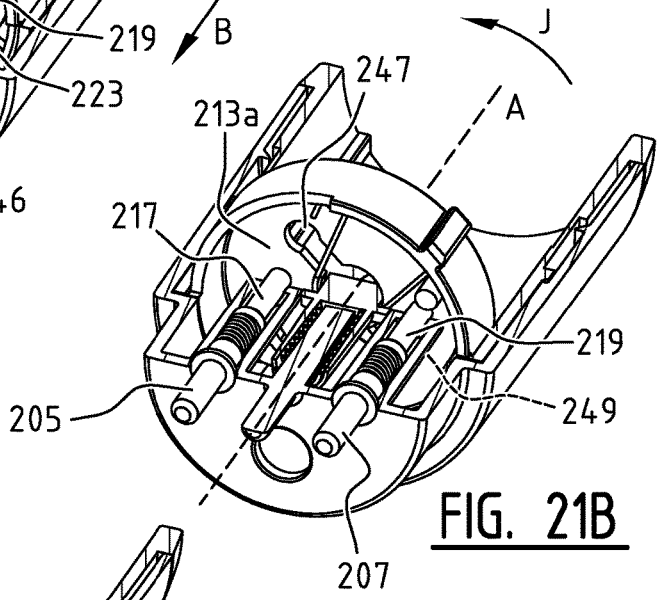

In FIGS. 21A and 21B a sectional view of the safety end cap assembly 200 is shown with the end cap cover element 203 in its protracted position and retracted position, respectively. As shown in FIG. 21A the connector pins 205 and 207 are arranged on the end wall 203*a* of the end cap cover element 203. Connector pin 205 is electrically connected to an electrically conductive contact element 217 that is slidably arranged in a cylindrical housing 245. Arranged between connector pin 205 and the associated contact element 217 is a coil spring 221 that urges a flange on one end of the contact element 217 against an end wall of the cylindrical housing 245 through which end wall the contact element 217 extends. Connector pin 207 is electrically connected to an electrically conductive contact element 219 that is slidably arranged in a cylindrical housing 246. Arranged between connector pin 207 and the associated contact element 219 is a coil spring 223 that urges a flange on one end of the contact element 219 against an end wall of the cylindrical housing 246 through which end wall the contact element 219 extends.

In the protracted position of the end cap cover element 203, shown in FIG. 21A, the contact elements 217 and 219 are not in contact with the front surface 213*a* of the switch button 213. When the end cap cover element 203 is moved in the direction of arrow C against the force exerted on the end cap cover element 203 by coil spring 206, the contact elements 217 and 219 are brought into contact with the front surface 213*a* of the switch button 213 and the coil springs 221 and 223 are compressed.

In the front surface 213*a* of the switch button 213 two holes 247 and 249 are arranged on either side of the central longitudinal axis A. In FIG. 21B only one of the holes is shown. In the position of the switch button 213 shown in FIG. 21B, the switch button 213 is in its open position.

Figure 22:
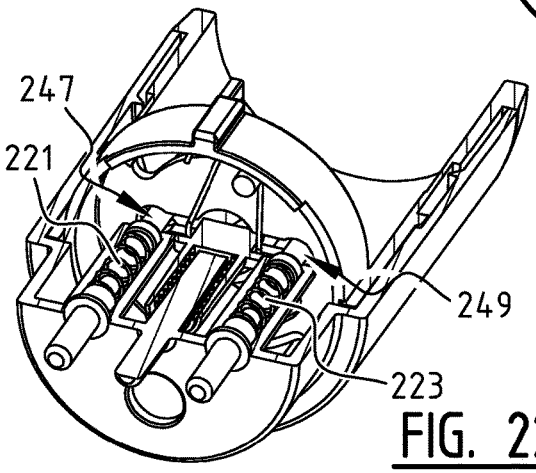

When rotating the switch button 213 in the direction of arrow J by engaging the part of the side surface 213*b* of the switch button 213 through the slot 211 in the end cap cover element 203 against the force exerted on the switch button 213 by torsion spring 215, the holes 247 and 249 rotate in the direction of arrow J until the holes 247 and 249 are aligned with contact elements 217 and 219, respectively. As shown in FIG. 22, the contact elements 217 and 219 are then pushed through the holes 247 and 249 by the coil springs 221 and 223. The switch button 213 is now in its closed position.

Figure 23:
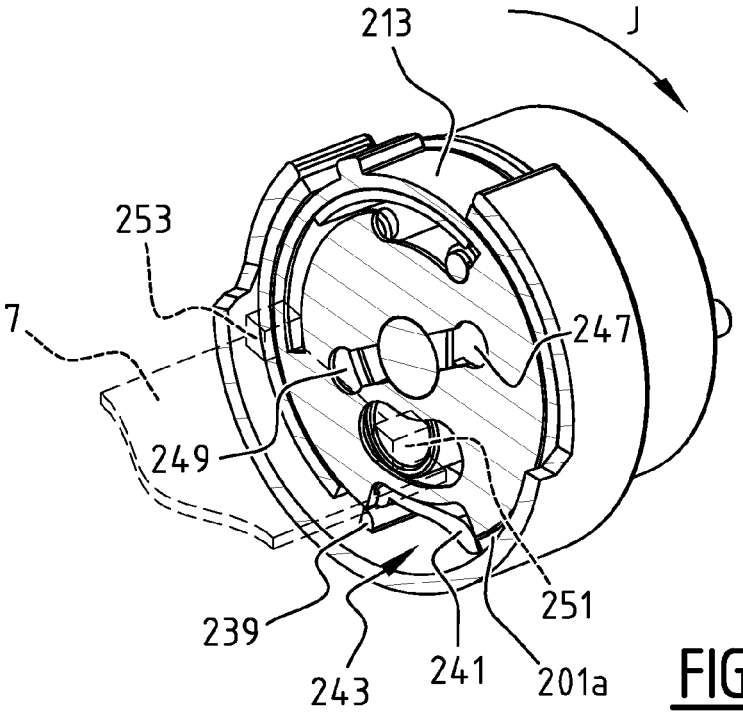

In FIG. 23 the rear side of the switch button 213 is show, with the switch button 213 in its open position. As shown, in this open position, contact elements 251 and 253 that are arranged on the circuit board 7 shown in FIG. 2 as a replacement of electrical leads 33, are not in contact with the contact elements 217, 219. In the open position of the switch button 213 the electrical switch of which the switch button 213 is a component, is thus in its open state.

As shown in FIG. 23, the switch button 213 is provided with a snap finger 241 at its circumference. The snap finger 241 protrudes in a slot 243 in the circumferential wall 201*a* of the end cap base element 201. A nose-shaped element 239 is arranged on the inside of the circumferential wall 203*a* of the end cap cover element 203. The nose-shaped retention element 239 is in the path of the snap finger 241 when the switch button 213 is rotated in the direction of arrow J into its closed position, and snaps over the nose-shaped retention element 239.

Figure 24:
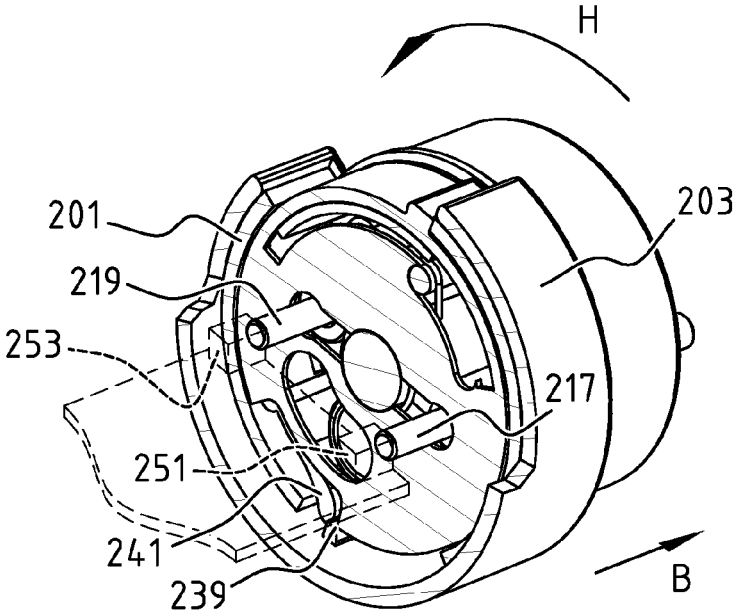

As shown in FIG. 24, that shows the rear side of the switch button 213 in its closed position, the contact elements 217, 219 extend through the holes 247, 249, and contact the contact elements 251 and 253 that are arranged on the circuit board 7. As a result in the closed position of the switch button 213, connector pin 205 is electrically connected to electrically conductive contact element 251 via electrically conductive coil spring 221 and electrically conductive contact element 217, while connector pin 207 is electrically connected to electrically conductive contact element 253 via electrically conductive coil spring 223 and electrically conductive contact element 219. Consequently, in the closed position of the switch button the connector pins 205, 207 are in electrical contact with the circuitry on the circuit board 7 shown in FIG. 2. In the closed position of the switch button 213, the electrical switch, of which the switch button 213 is a component, is in its closed state.

With the switch button 213 in its closed position, the snap finger 241 and the nose-shaped retention element 239 are in engagement with each other and thus cooperate to prevent torsion spring 215 to force the switch button 213 in the direction of arrow H back into its open position.

If the end cap cover element 203 is moved in the direction of arrow B towards its protracted position under influence of the coil spring 206, the contact elements 217, 219 are moved in the direction of arrow B out of the holes 247, 249. Furthermore, as shown, the nose-shaped retention elements 239 extends in longitudinal direction over only a part of the length of the slot 243. As a result, if the end cap cover element 203 is moved in the direction of arrow B towards its protracted position under influence of the coil spring 206, the nose-shaped retention element 239 is moved relative to the snap finger 241 in the direction of arrow B. When the snap finger 241 has entered the part of the slot 243 in which the nose-shaped retention element 239 does not extend, the nose-shaped retention element 239 and snap finger 241 do no longer engage each other and the switch button 213 is no longer retained in its closed position. Under influence of the torsion spring 215, the switch button 213 is then rotated in the direction of arrow H into its open position. The electrical switch of which the switch button 213 is a component is then in its open state in which the contact elements 217 and 219 are then no longer in electrical contact with the contact elements 251 and 253 that are arranged on the circuit board 7.

Figure 25:
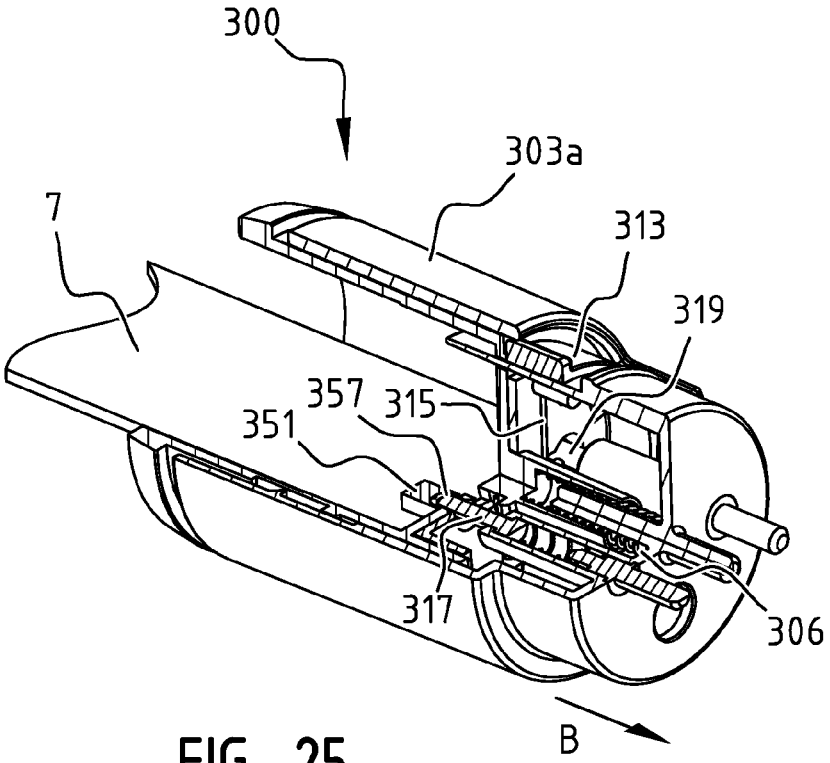
FIGS. 25 and 26 show an alternative embodiment of the safety end cap assembly of FIGS. 20 to 24.
Figure 26:
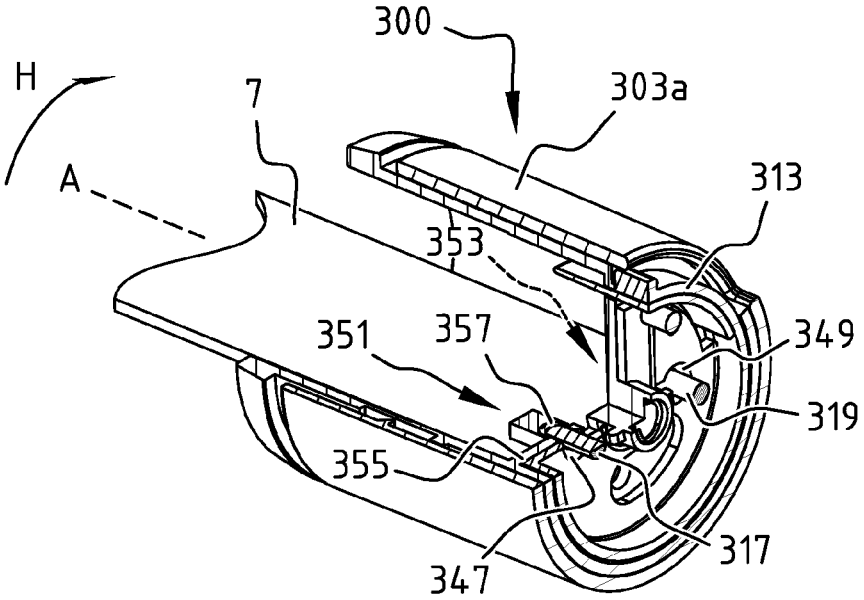

In FIGS. 25 and 26 an alternative embodiment is shown of the safety end cap assembly 200 as shown in FIGS. 20 to 24. Many of the components of the safety end cap assembly 300 shown in FIGS. 25 and 26 correspond to components of the safety end cap assembly 200. In the following description and in the figures of the safety end cap assembly 300 corresponding components have the same reference sign, albeit that the reference sign is in the 300-range instead of the 200-range. Furthermore, the working principle of the safety end cap assembly 300 is essentially the same as the working principle of the safety end cap assembly 200. Therefore, in the following description only the differences between the safety end cap assembly 200 and the safety end cap assembly 300 will be discussed.

The main difference between the safety end cap assembly 300 and the safety end cap assembly 200 is that the switch button 213 is not retained in its closed position by means of a snap finger arranged on the switch button 313 and a nose-shaped retention element arranged on the inside of the circumferential wall 303*a* of the end cap cover element 303. Instead, as shown in FIGS. 25 and 26 that show the switch button in its closed position, the switch button 313 is retained in its closed position by means of the contact elements 317 and 319. Contact element 317 extends through the hole 347 in the switch 313, subsequently through a hole in an additional transverse wall 355 of the end cap base element 301, and finally in a cavity 357 of contact element 351 that is arranged on the circuit board 7. Contact element 319 extends through the hole 349 in the switch 313, subsequently through a hole in an additional transverse wall 355 of the end cap base element 301, and finally in a cavity of contact element 353 that is arranged on the circuit board 7.

If the end cap cover element 303 is moved in the direction of arrow B towards its protracted position under influence of the coil spring 306, the contact elements 317, 319 are moved in the direction of arrow B out of the cavities in the contact elements 351, 353, out of the holes additional transverse wall 355 of the end cap base element 301, and out of the holes 347, 349 in the switch button 313. The switch button 313 is no longer retained in its closed position. Under influence of the torsion spring 315, the switch button 313 is then rotated in the direction of arrow H into its open position. The electrical switch of which the switch button 313 is a component is then in its open state in which the contact elements 317 and 319 are no longer in electrical contact with the contact elements 351 and 353 that are arranged on the circuit board 7.

In the embodiments shown in the figures a LED tube assembly is provided with a safety end cap assembly at one end of the LED tube assembly. It would also be possible to provide a LED tube assembly with a safety end cap according to the invention on either end of the LED tube assembly.

In the embodiments shown in the figures a LED tube assembly is provided with a safety end cap assembly according to the invention. It would also be possible to provide a safety end cap assembly according to the invention on other than tube shaped lights.

In the embodiments shown in the FIGS. 1 to 19 the end cap cover element covers the connector pins completely when it is in its protracted position. In the embodiments shown in the FIGS. 20 to 26 the end cap cover element does not cover the connector pins when it is in its protracted position. It would also be possible that the end cap cover element covers only partly the connector pins when it is in its protracted position, as long as with the end cap cover element in its protracted position the LED tube assembly does not fit in a light fixture and with the end cap cover element in its retracted position the LED tube assembly does fit in a light fixture.

In the embodiments shown in the figures a pin shaped protrusion extends outwardly from the bottom wall of the end cap cover element, which in the retracted position of the end cap cover element extends between the connector pins. It would also be possible to omit this protrusion. It would furthermore be possible to provide the end cap at the other end of the LED tube assembly with such a protrusion that extends between the connector pins. Such a protrusion extending between the connector pins of an end cap, preferably in combination with a safety switch that functions separately from the protrusion, as such can be regarded as an invention by means of which possible hazardous situations during the installation of a LED tube assembly in a light fixture can be reduced.

While the principles of the invention have been set out above in connection with specific embodiments, it is to be understood that this description is merely made by way of example and not as a limitation of the scope of protection, which is determined by the appended claims.

The invention claimed is:

1. A safety end cap assembly to be arranged on an end of an elongate housing of a LED tube, comprising an end cap base element, one end of the end cap base element to be arranged on an end of the elongate housing;

at least one connector pin extending along a longitudinal axis of the end cap base element;

an electrical switch electrically connected to the at least one connector pin and switchable between an open state and a closed state via a switch button arranged on the end cap base element; and an end cap cover element arranged slidable on the end cap base element along said longitudinal axis between a protracted position, in which the switch button is covered by the end cap cover element, and a retracted position, in which the switch button is exposed;

wherein in the protracted position the end cap cover element extends beyond the end of the end cap base element opposite the end to be arranged on the end of the elongate housing; and wherein for sliding the end cap cover element from the protracted position to the retracted position, the end cap cover element is moved towards the end cap base element.

2. The safety end cap assembly according to claim 1, wherein the at least one connector pin is arranged on the end cap cover element or on the end cap base element.

3. The safety end cap assembly according to claim 2, wherein the switch is embodied as a micro-switch unit that is operated via the switch button.

4. The safety end cap assembly according to claim 1, wherein the at least one connector pin is arranged on the end cap base element;

and wherein in the retracted position of the end cap cover element, the at least one connector pin is exposed; and in the protracted position of the end cap cover element, the end cap cover element covers the at least one connector pin such that the connector pin is not exposed.

5. The safety end cap assembly according to claim 4, wherein the switch is embodied as a micro-switch unit that is operated via the switch button.

6. The safety end cap assembly according claim 1, wherein the safety end cap assembly further comprises:

a spring mechanism configured to urge the end cap cover element toward the protracted position; and a switch opening mechanism configured, in case the switch is in the closed state and the end cap cover element is slid into the protracted position, to switch the switch to the open state.

7. The safety end cap assembly according claim 6, wherein the switch button is displaceable between an open position in which the switch is in the open state and a closed position in which the switch is in the closed state;

the switch opening mechanism comprises:

a spring mechanism to urge the switch button towards the open position;

a switch button arresting mechanism associated with the end cap cover element and the switch button, the switch button arresting mechanism being configured to, in the retracted position of the end cap cover element, arrest the switch button in the closed position, wherein in the protracted position of the end cap cover element, the arresting mechanism cannot arrest the switch button in the closed position.

8. The safety end cap assembly according to claim 7, wherein the switch button comprises an electrically insulating separation wall and an electrically conductive contact element arranged on one side of the separation wall, the electrically conductive contact element being electrically connected to the at least one connector pin;

wherein the separation wall is displaceable together with the switch button; and wherein with the switch button in the open position, the separation wall prevents an electrical connection between the electrically conductive contact element connected to the at least one connector pin and an electrically conductive contact element arranged on the opposite side of the separation wall;

and with the switch button in the closed position, the separation wall provides a path for electrically connecting the electrically conductive contact element connected to the at least one connector pin to an electrically conductive contact element arranged on the opposite side of the separation wall.

9. The safety end cap assembly according to claim 8, wherein the separation wall includes an electrically conductive surface arranged on either side of the separation wall, the electrically conductive surfaces being electrically connected;

the electrically conductive contact element connected to the at least one connector pin is, at least with the end cap cover element in the retracted position, spring loaded against the separation wall;

and wherein with the switch button in the closed position a first of the electrically conductive surfaces is in contact with the electrically conductive contact element connected to the at least one connector pin; and with the switch button in the open position the first of the electrically conductive surface is positioned away from the electrically conductive contact element connected to the at least one connector pin.

10. The safety end cap assembly according to claim 6, wherein the switch is embodied as a micro-switch unit that is operated via the switch button.

11. The safety end cap assembly according to claim 8, wherein the separation wall includes a through hole;

and wherein:

with the switch button in the closed position the through hole is aligned with the electrically conductive contact element connected to the at least one connector pin to allow the electrically conductive contact element to extend through the through hole;

and with the switch button in the open position the through hole is misaligned with the electrically conductive contact element connected to the at least one connector pin.

12. The safety end cap assembly according to claim 11, wherein the at least one connector pin and the electrically conductive contact element electrically connected therewith are arranged on the end cap cover element;

and wherein:

with the end cap cover element in the protracted position the electrically conductive contact element electrically connected to the at least one connector pin is positioned away from the separation wall;

with the end cap cover element in the retracted position and the switch button in the open position the electrically conductive contact element electrically connected to the at least one connector pin is in spring loaded contact with the separation wall; and with the end cap cover element in the retracted position and the switch button in the closed position the electrically conductive contact element electrically connected to the at least one connector pin extends through the through hole in the separation wall.

13. The safety end cap assembly according to claim 12, wherein with the end cap cover element in the retracted position and the switch button in the closed position, the electrically conductive contact element that is electrically connected to the at least one connector pin and that extends through the through hole in the separation wall, arrests the switch button in the closed position.

14. The safety end cap assembly according to claim 8, wherein the arrest mechanism comprises:

a protrusion associated with the end cap cover element that is displaceable along a path together with the end cap cover element; and a snap finger associated with the switch button that is displaceable along a path together with the switch button;

wherein the path of the snap finger and the path of the protrusion cross; and the snap finger and the protrusion are configured such that:

in the retracted position of the end cap cover element the protrusion is in path of the snap finger such that, in case in the retracted position of the end cap cover element the switch button is displaced from the open position in the closed position, the snap finger snaps over the protrusion and the switch button is held the closed position;

and that in protracted position of the end cap cover element, the protrusion is not in path of the snap finger.

15. The safety end cap assembly according to claim 1, wherein the at least one connector pin includes two connector pins, the safety end cap assembly further comprising a protrusion extending parallel to the two connector pins and arranged, at least in the retracted position of the end cap cover element, between the two connector pins.

16. The safety end cap assembly according to claim 1, wherein the switch is embodied as a micro-switch unit that is operated via the switch button.

17. An LED tube assembly, comprising:

an elongate housing having arranged therein LEDs; and a safety end cap assembly on at least one longitudinal end of the elongate housing, the safety end cap assembly comprising:

an end cap base element, one end of the end cap base element to be arranged on an end of the elongate housing;

at least one connector pin extending along a longitudinal axis of the end cap base element;

an electrical switch electrically connected to the at least one connector pin and switchable between an open state and a closed state via a switch button arranged on the end cap base element; and an end cap cover element arranged slidable on the end cap base element along said longitudinal axis between a protracted position, in which the switch button is covered by the end cap cover element, and a retracted position, in which the switch button is exposed;

wherein in the protracted position the end cap cover element extends beyond the end of the end cap base element opposite the end to be arranged on the end of the elongate housing; and wherein for sliding the end cap cover element from the protracted position to the retracted position, the end cap cover element is moved towards the end cap base element.

18. The LED tube assembly according to claim 17, configured to be fit in a lamp fixture, wherein with the end cap cover element in the protracted position the LED tube assembly does not fit in said lamp fixture; and with the end cap cover element in the retracted position the LED tube assembly does fit in said lamp fixture.

* * * * *